US009722351B2

(12) United States Patent
Youtsey

(10) Patent No.: US 9,722,351 B2
(45) Date of Patent: Aug. 1, 2017

(54) COAXIAL CABLE CONNECTOR HAVING A BODY WITH AN INTEGRAL FLEXIBLE PAWL TO CAPTURE A COAXIAL CABLE

(71) Applicant: PCT International, Inc., Mesa, AZ (US)

(72) Inventor: Timothy L. Youtsey, Mesa, AZ (US)

( * ) Notice: Subject to any disclaimer, the term of this patent is extended or adjusted under 35 U.S.C. 154(b) by 0 days.

(21) Appl. No.: 15/082,644

(22) Filed: Mar. 28, 2016

(65) Prior Publication Data

US 2016/0211608 A1 Jul. 21, 2016

Related U.S. Application Data

(63) Continuation of application No. 14/735,029, filed on Jun. 9, 2015, now Pat. No. 9,300,094, which is a continuation of application No. 14/188,474, filed on Feb. 24, 2014, now Pat. No. 9,088,078.

(60) Provisional application No. 61/768,943, filed on Feb. 25, 2013.

(51) Int. Cl.

| | |
|---|---|
| ***H01R 9/05*** | (2006.01) |
| ***H01R 13/58*** | (2006.01) |
| ***H01R 24/38*** | (2011.01) |

(52) U.S. Cl.

CPC ..... *H01R 13/5825* (2013.01); *H01R 9/0518* (2013.01); *H01R 9/0527* (2013.01); *H01R 13/582* (2013.01); *H01R 24/38* (2013.01)

(58) Field of Classification Search

CPC ..... H01R 9/05; H01R 9/0518; H01R 9/0524; H01R 13/6271; H01R 9/0527; H01R 13/58; H01R 13/582

USPC ..... 439/578–585, 352–358

See application file for complete search history.

(56) References Cited

U.S. PATENT DOCUMENTS

| | | | | |
|---|---|---|---|---|
| 7,288,002 | B2 * | 10/2007 | Rodrigues | H01R 13/5816 439/439 |
| 7,300,309 | B2 * | 11/2007 | Montena | H01R 9/0524 439/578 |
| 7,588,460 | B2 * | 9/2009 | Malloy | H01R 13/5202 439/578 |
| 7,857,661 | B1 * | 12/2010 | Islam | H01R 9/0521 439/584 |
| 7,997,930 | B2 * | 8/2011 | Ehret | H01R 13/622 439/320 |
| 8,657,626 | B2 * | 2/2014 | Duval | H01R 13/5205 439/583 |
| 9,040,822 | B2 * | 5/2015 | Nieto Lopez | H02G 1/00 174/138 F |
| 9,088,078 | B2 * | 7/2015 | Youtsey | H01R 9/0527 |
| 9,172,157 | B2 * | 10/2015 | Burris | H01R 9/0524 |
| 9,300,094 | B2 * | 3/2016 | Youtsey | H01R 9/0527 |
| 2002/0164900 | A1 * | 11/2002 | Youtsey | H01R 9/0527 439/578 |

(Continued)

*Primary Examiner* — Chandrika Prasad

(74) *Attorney, Agent, or Firm* — Thomas W. Galvani, P.C.; Thomas W. Galvani

(57) ABSTRACT

A coaxial cable connector has a body and a longitudinal axis bounding an interior of the body. A pawl is carried in the interior of the body for engaging with a coaxial cable applied to the interior and for preventing the removal of the cable after having been applied to the interior. The pawl moves out of and into interference with the cable in response to the introduction of the cable into the interior and to the retraction of the cable along the longitudinal axis, respectively.

17 Claims, 16 Drawing Sheets

(56) References Cited

U.S. PATENT DOCUMENTS

2011/0143586 A1* 6/2011 Ehret ..... H01R 13/622
439/584

* cited by examiner

COAXIAL CABLE CONNECTOR HAVING A BODY WITH AN INTEGRAL FLEXIBLE PAWL TO CAPTURE A COAXIAL CABLE

CROSS-REFERENCE TO RELATED APPLICATIONS

This application is a continuation of and claims the benefit of prior U.S. patent application Ser. No. 14/735,029, filed Jun. 9, 2015, which is a continuation of and claimed the benefit of prior U.S. patent application Ser. No. 14/188,474, filed Feb. 24, 2014, which claimed the benefit of U.S. Provisional Application No. 61/768,943, filed Feb. 25, 2013, all of which are hereby incorporated by reference.

FIELD OF THE INVENTION

The present invention relates generally to electrical apparatuses, and more particularly to coaxial cable connectors.

BACKGROUND OF THE INVENTION

Coaxial cables transmit radio frequency ("RF") signals between transmitters and receivers and are used to interconnect televisions, cable boxes, DVD players, satellite receivers, modems, and other electrical devices. Typical coaxial cables include an inner conductor surrounded by a flexible dielectric insulator, a foil layer, a conductive metallic tubular sheath or shield, and a polyvinyl chloride jacket. The RF signal is transmitted through the inner conductor. The conductive tubular shield provides a ground and inhibits electrical and magnetic interference with the RF signal in the inner conductor.

Coaxial cables must be fit with cable connectors to be coupled to electrical devices. Connectors typically have a connector body, a coupling nut or threaded fitting mounted for rotation on an end of the connector body, a bore extending into the connector body from an opposed end to receive the coaxial cable, and an inner post within the bore coupled in electrical communication with the fitting. Generally, connectors are crimped with a tool onto a prepared end of a coaxial cable to secure the connector to the coaxial cable. However, crimping occasionally results in a crushed coaxial cable which delivers a signal degraded by leakage, interference, or poor grounding. Furthermore, while some connectors are so tightly mounted to the connector body that threading the connector onto the post of an electrical device can be incredibly difficult, other connectors have fittings that are mounted so loosely that the electrical connection between the fitting and the inner post can be disrupted when the fitting moves off of the post. Still further, some connectors, if applied too loosely to the cable, will come out of the connector, completely severing the RF connection between the transmitter and the electrical device. Yet still further, connectors typically must be installed with a tool onto a cable, and for those that do not require installation tools, a good quality connection is very difficult to achieve between the cable and the connector. An improved connector for coaxial cables is needed.

SUMMARY OF THE INVENTION

A coaxial cable connector has a body and a longitudinal axis bounding an interior of the body. A pawl is carried in the interior of the body for engaging with a coaxial cable applied to the interior and for preventing the removal of the cable after having been applied to the interior.

BRIEF DESCRIPTION OF THE DRAWINGS

Referring to the drawings.

DETAILED DESCRIPTION

Figure 1:
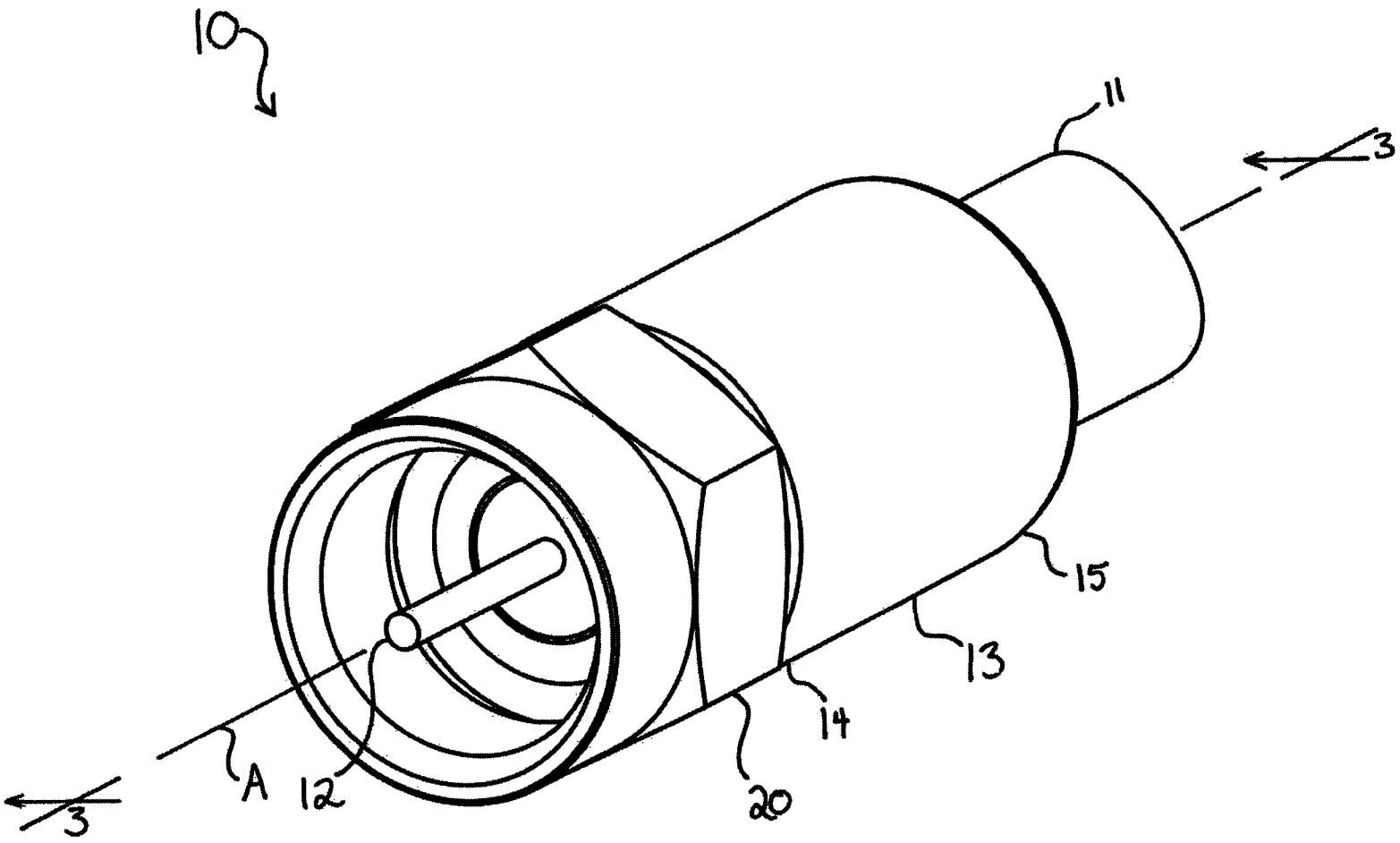
FIG. 1 is a front perspective view of an embodiment of a coaxial cable connector constructed and arranged according to the principle of the invention, shown as it would appear applied on a coaxial cable.

Reference now is made to the drawings, in which the same reference characters are used throughout the different figures to designate the same elements. FIG. 1 illustrates a coaxial cable connector 10 constructed and arranged in accordance with the principle of the invention, as it would appear in an applied condition on a coaxial cable 11. The cable 11 is exemplary of a conventional coaxial cable, such as an RG6 coaxial cable, and includes an inner conductor 12, shown in FIG. 1 extending out of the connector 10, for the communication of radio frequency ("RF") signals. The connector 10 includes a cylindrical body 13 having opposed front and rear ends 14 and 15 and a coaxial threaded fitting or coupling nut 20 mounted for rotation to the front end 14 of the body 13. A longitudinal axis A extends through the center of the connector 10, and the body 13 and the coupling nut 20 have rotational symmetry with respect to the longitudinal axis A.

Figure 2A:
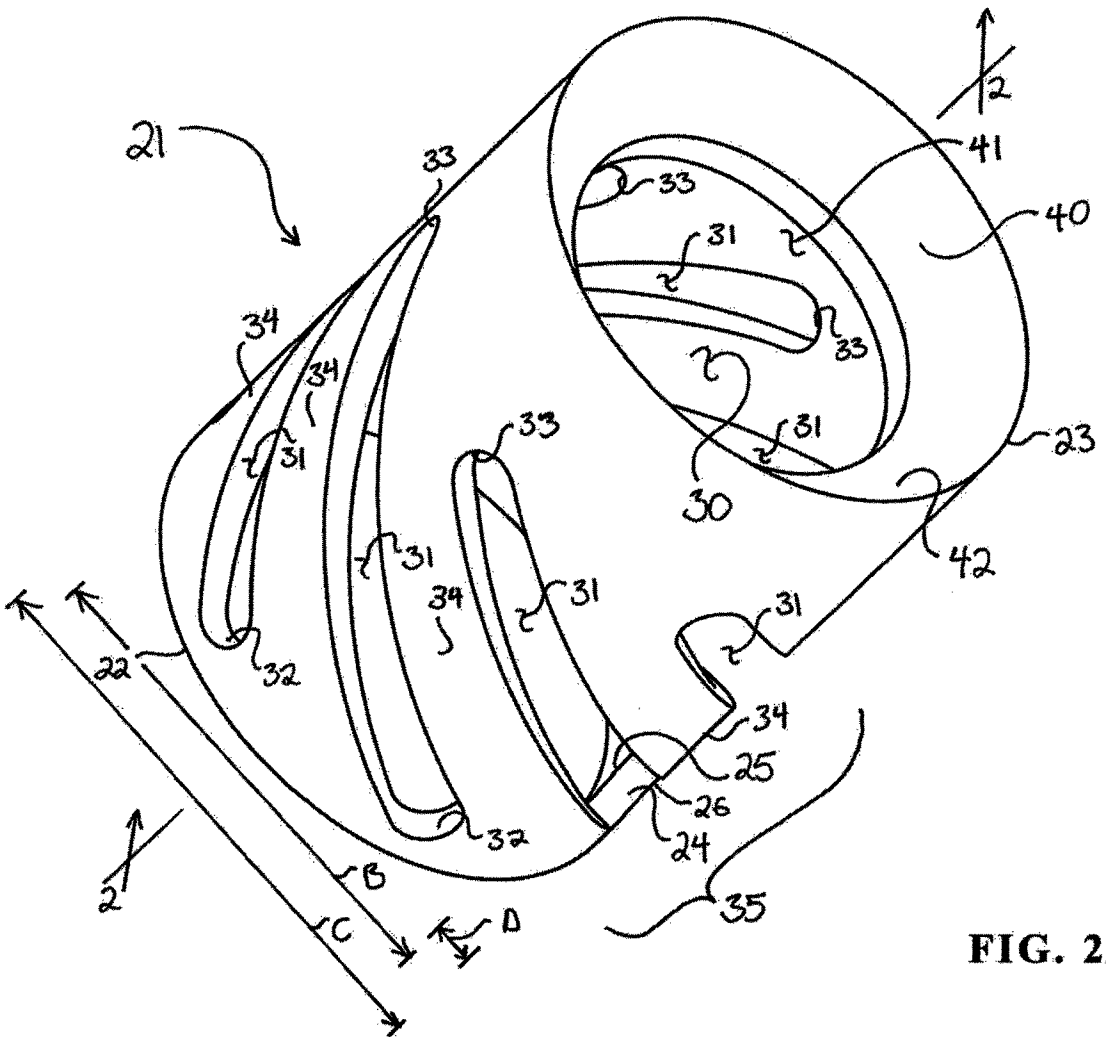
FIG. 2A is a rear perspective view of an inner sleeve of the coaxial cable connector of FIG. 1.

The body 13 of the connector 10 houses an inner sleeve 21, shown in isolation in FIG. 2A. The inner sleeve 21 has an open front end 22, an opposed open rear end 23, and a cylindrical sidewall 24 extending between the front and rear ends 22 and 23 and including opposed inner and outer surfaces 25 and 26. The inner surface 25 of the sleeve 21 bounds and defines a bore 30 having a consistent inner diameter B through the sleeve 21 from the front end 22 through the rear end 23, which bore 30 is structured to closely receive the coaxial cable 11. The outer surface 26 has an outer diameter C which is larger than the inner diameter B by a thickness D of the sidewall 24.

Figure 2B:
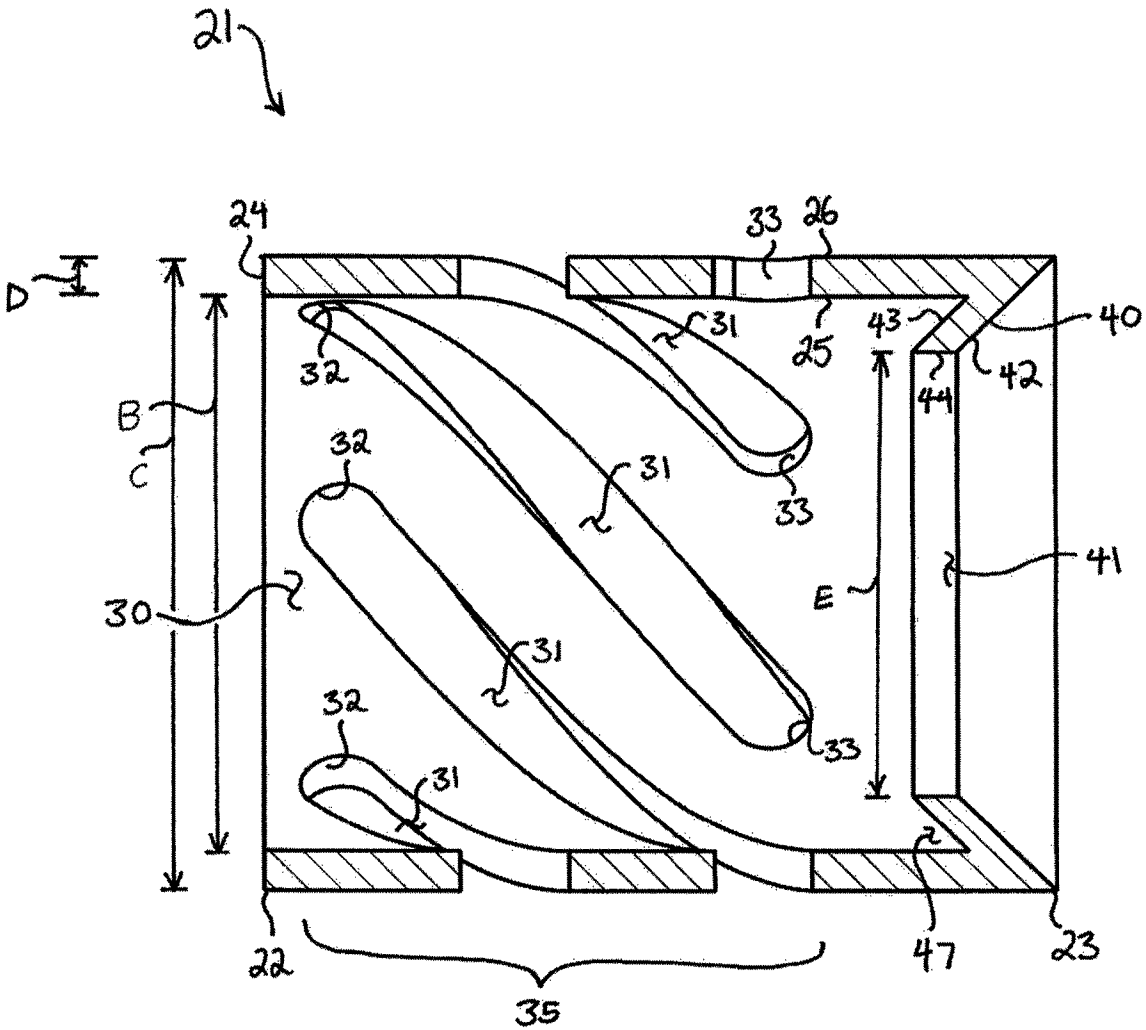
FIG. 2B is a section view of the inner sleeve of FIG. 2A taken along the line 2-2 in FIG. 2A.
Figure 3A:
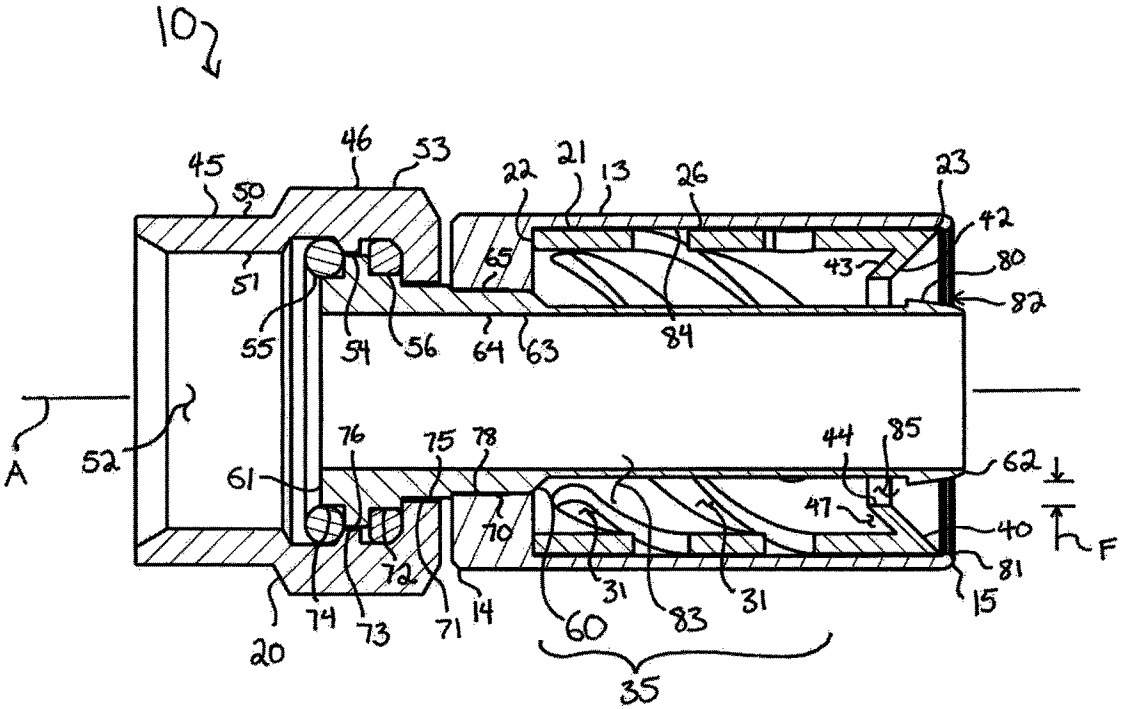
FIGS. 3A-3C are section views taken along the line 3-3 in FIG. 1 showing a sequence of steps of applying the coaxial cable to the coaxial cable connector of FIG. 1.
Figure 3B:
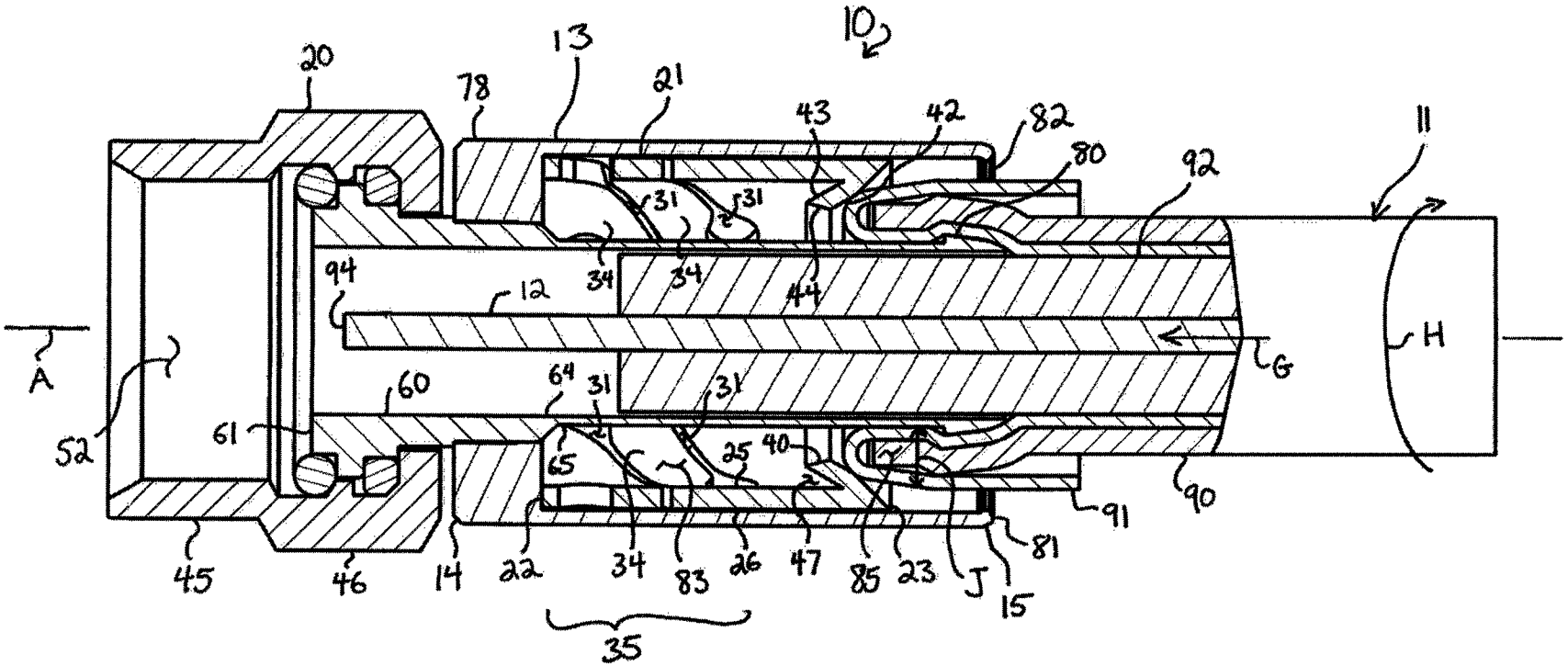

The sleeve 21 is provided with a compression assembly 35 formed integrally in the sidewall 24, and including a plurality of helical slots 31 formed through the sidewall 24 from the inner surface 25 to the outer surface 26, defining diagonal structural ribs 34 of the sidewall 24. The slots 31 between the ribs 34 allow the compression assembly 35 to move between an uncompressed condition (as shown in FIGS. 2A, 2B, and 3A) and a compressed condition (as shown in FIG. 3B) in response to axial application of the cable 11 into the connector 10 so as to engage the cable 11 to create a secure coupling between the connector 10 and the cable 11. The front and rear ends 22 and 23 are both continuous and unbroken by the slots 31. Each slot 31 has a forward end 32 proximate to the front end 22 of the sleeve 21, and an opposed rearward end 33 which is inboard of the rear end 23 and is angularly offset with respect to the respective forward end 32 of the respective slot 31, so that each slot 31 is aligned helically in the sidewall 24 of the sleeve 21, disposed in a counter-clockwise rotational direction from the forward end 32 to the rear end 33. One having reasonable skill in the art will readily appreciate that the slots 31 could be aligned in an opposite direction, namely, in a clockwise direction from the forward end 32 to the rear end 33. When the cable 11 is introduced into the bore 30 of the sleeve 21, the slots 31 collapse in response to axial compression of the sleeve 21 between the front and rear ends 22 and 23 thereof, with the ribs 34 moving together as the front and rear ends 22 and 23 move together. As the term is used here "axial" means extending or aligned parallel to the longitudinal axis A, and the term "radial" means aligned along a radius extending from the longitudinal axis A.

FIG. 2B is a section view taken along the line 2-2 in FIG. 2A. A lip 40, shown in FIG. 2B, and formed on the inner surface 25, bounds and defines an opening 41 into the bore 30 from the rear end 23 which has a reduced diameter identified by the reference character E in FIG. 2B. The lip 40 is a continuous annular extension of the sidewall 24 projecting radially inwardly and forwardly toward the front end 22 of the sleeve 21. The lip 40 is a pawl, or engagement element, for engagement with the cable 11 that moves between an initial, raised condition, in which the lip 40 is ready to receive application of the cable 11, a deflected condition in response to application of the cable 11 to the connector 10 in which the lip 40 accommodates the cable 11, and an interference condition in response to retraction of the cable 11 from the connector 10 in which the lip 40 engages the cable 11 and prevents removal of the cable 11 from the sleeve 21. As will be explained, the lip 40 moves into the deflected condition and the sleeve 21 compresses axially in response to the cable 11 being applied to the sleeve 21 so as to engage the cable 11, consistent with the mechanism of a pawl. A pawl is a pivoted lever adapted to engage with an element to allow forward movement of the element and prevent backward movement of the element.

Still referring to FIG. 2B, the lip 40 has a continuous inclined face 42 directed toward the rear end 23 of the sleeve and an opposed continuous back 43 directed toward the front end 22. The face 42 and back 43 meet at a flat, annular edge 44 which extends continuously around the lip 40 and is directed radially inward. The lip 40 is constructed of a material or combination of materials having semi-rigid, flexible, and elastic material characteristics, allowing the lip 40 to flex radially outward along a living hinge at the inner surface 25 toward the sidewall 24, resist flexing radially inward toward the center of the sleeve 21, and return to its original position after flexing. In this way, the lip 40 operates as a pawl to deflect and allow forward movement and to resist rearward movement. An annular deflection space 47 lies between the back 43 and the inner surface 25 of the sidewall 24 to accommodate the lip 40 as it flexes radially outwardly into the deflected condition.

FIG. 3A is a section view taken along the line 3-3 of FIG. 1, showing the connector 10 with the sleeve 21 carried in the body 13 of the connector 10. As seen, the fitting 20 is a monolithic, cylindrical sleeve having an integrally-formed ring portion 45 and an integrally-formed nut portion 34. The ring portion 45 has a smooth annular outer surface 50 and an opposed threaded inner surface 51 defining a bore 52 into which a female post element of an electrical device is inserted. Briefly, as used throughout this description, the phrase "electrical device" includes any electrical device having a female post to receive a male coaxial cable connector for the transmission of RF signals such as cable television, satellite television, internet data, and like RF signals. The nut portion 46 of the fitting 20 has a hexagonal outer surface 53 to be engaged by the jaws of an installation tool, or for easy gripping by hand, and an opposed inner surface 54 formed with grooves in which gaskets 55 and 56 are disposed. The fitting 20 is constructed of a material or combination of materials having strong, hard, rigid, durable, and high electrically-conductive material characteristics, such as metal.

Referring still to FIG. 3A, the body 13 and the coupling nut 20 are carried on an electrically conductive inner post 60. The inner post 60 is cylindrical, extends coaxially along the longitudinal axis A between a front end 61 and an opposed rear end 62, and has a sidewall 63 with opposed inner and outer surfaces 64 and 65. The outer surface 65 proximate to the front end 61 of the inner post 60 is formed with a plurality of annular shoulders 70, 71, 72, 73, and 74 each of which is engaged to one of the body 13 and the coupling nut 20. The front end 14 of the body 13 is mounted to the shoulder 70 in a tight, press-fit arrangement fixing the body 13 on the inner post 60. The coupling nut 20 is mounted for rotation on the front end 61 of the inner post 60 and provides a connection maintaining continuous electrical communication from the electrical device through the coupling nut 20 to the inner post 60. An annular rear collar 75 of the coupling nut 20 is spaced just apart radially from the shoulder 71, an inwardly-directed annular ridge 76 on the inner surface 54 of the coupling nut 20 is spaced just apart from the shoulder 73, and the gaskets 55 and 56 are disposed and compressed between the shoulders 72 and 74 and the inner surface 54 of the coupling nut 20, providing a bearing surface with a low coefficient of rolling friction. A contact 77 is formed between the shoulder 72 and the rear collar 75 of the coupling nut 20, coupling the coupling nut 20 and the inner post 60 in good electrical communication. The gaskets 55 and 56 provide two barriers to moisture entry between the inner post 60 and the coupling nut 20 to prevent disruption of the electrical communication between the coupling nut 20 and the inner post 60. The gaskets 55 and 56 are constructed of a material or combination of materials having deformable, resilient, shape-memory, water impermeable, and durable material characteristics, such as rubber or a rubber compound.

The rear end 62 of the inner post 60 is formed with a continuous annular barb or ridge 80 projecting toward the front end 61 of the inner post 60 and radially outward from the longitudinal axis A into the interior of the cylindrical body 13. The ridge 80 defines an enlarged head to the inner post 60 at the rear end 62 of the inner post 60 over which the cable 11 must be advanced to be applied to the connector 10. The inner post 60 is constructed of a material or combination of materials having hard, rigid, durable, and high electrically-conductive material characteristics, such as metal.

The body 13 is carried on the inner post 60, and the sleeve 21 is carried within the body 13 against the inner surface of the body 13. Still referring to FIG. 3A, the front end 14 of the body 13 includes a bore extending therethrough which forms a wide collar 78 that is mounted on the shoulder 70 of the inner post 60. The collar 78 is fixed to the shoulder 71 by the press-fit engagement between the body 13 and the inner post 60. The rear end 15 of the body 13 includes a slightly inwardly-turned mouth 81 defining a reduced-diameter opening 82 into a rear bore 83 through the body 13 encircled by an inner surface 84 of the body 13. The body 13 is strong, rigid, and electrically-insulative, and is constructed of a material or combination of materials having those characteristics, such as plastic.

The sleeve 21 is fit between the collar 78 at the front end 14 of the body 13 and the mouth 81 at the rear end 15, and the full length of the outer surface 26 of the sleeve 21 is received in juxtaposition against the inner surface 84 of the body 13 in a frictional-fit engagement preventing relative rotational movement of the sleeve 21 within the collar 13. The collar 78 at the front end 14 of the body 13 prevents forward axial movement of the front end 22 of the sleeve 21 toward the coupling nut 20, and the interaction of the rear end 23 of the sleeve 21 against the inwardly-turned mouth 81 prevents axial movement of the rear end 23 out of the rear bore 83. The sleeve 21 is thus disposed between the inner surface 84 of the body 13 and the outer surface 65 of the inner post 60, and the lip 40 of the sleeve 21 is opposed from and slightly inboard with respect to the ridge 80, so that the ridge 80 is disposed between the lip 40 and the mouth 81 when the sleeve 21 is in the uncompressed condition thereof. The edge 44 of the lip 40 cooperates with the annular ridge 80 at the rear end 62 of the inner post 60 to define an annular gap 85 forming an entrance to the rear bore 83. The annular gap 85 has a width F between the ridge 80 and the lip 40, as shown in FIG. 3A. The width F corresponds to a tight clearance between the ridge 80 and the opposed lip 40, so that the cable 11 encounters both the lip 40 and ridge 80 nearly concurrently when applied to the connector 10.

With reference now to FIG. 3B, to apply the connector 10 onto the cable 11, the cable 11 is stripped and prepared according to well-known and conventional techniques, including stripping off a portion of a jacket 90 and folding back a flexible shield 91 over the jacket 90 to expose a dielectric 92 encircling the inner conductor 12 at an exposed end 94 of the coaxial cable 11. The end 94 of the cable 11 is introduced into the connector 10 by taking up the cable 11, such as by hand, and aligning the inner conductor 12 with the longitudinal axis A, presenting the end 94 to the opening 82, and passing the end 94 into the rear bore 83 along a direction generally indicated by the arrowed line G in FIG. 3B. Tools are not required for the application and installation of the connector 10 onto the cable 11, as the connector 10 can be fixed on the cable 11 by hand alone. The inner conductor 12 and the dielectric 92 enter the rear bore 83 inside the inner post 60 against the inner surface 64 of the inner post 60. The shield 91, which is curled back over the jacket 90, moves against and over the ridge 80, over the outer surface 65 of the inner post 60, and encounters the face 42 of the lip 40. The lip 40 is initially directed radially inward in an interference condition. The jacket 90, and the shield 91 folded back over the jacket 90, have a thickness J shown in FIG. 3B, which is greater than the width F (shown in FIG. 3A) of the annular gap 85 between the lip 40 and ridge 80, so that the lip 40 and the ridge 80 cooperate to define an interference to the advancement of the cable 11 along the direction of arrowed line G.

Application of an increased amount of axial force along arrowed line G causes the cable 11 to advance through the annular gap 85, deflecting the lip 40 along line G and radially outward toward the deflected condition of the lip 40, out of the interference condition, as seen in FIG. 3B. The flexible material characteristic of the lip 40 allows the lip 40 to deform slightly in response to the increased application of axial force imparted by advancement of the cable 11 along line G. The back 43 of the lip 40 is moved closer to the inner surface 25 of the sleeve, reducing the deflection space 47 and directing the edge 44 toward the front end 14 of the body 13.

As the lip 40 moves toward the deflected condition, the sleeve 21, to which the lip 40 is integrally formed, also begins to compress in the axial direction, as shown in FIG. 3B, in response to continued forward application of the cable 11 into the connector 10. The slots 31 and ribs 34 of the compression assembly 35 provide the sidewall 24 of the sleeve 21 with axial compression characteristics to accommodate the compression. As the sleeve 21 compresses, the slots 31 collapse and the ribs 34 spaced apart by the slots 31 come together, reducing the length of the sleeve 21 between the front and rear ends 22 and 23. Compression of the sleeve 21 causes the lip 40 to move down the body 13 toward the front end 14 and away from the ridge 80 of the inner post 60. Thus, as the cable 11 moves into the connector 10, the sleeve 21 compresses and the lip 40 on the sleeve 21 yields or deflects. The tight clearance between the lip 40 and the ridge 80 is relaxed because the lip 40 is moved out of its original, opposed position with respect to the ridge 80. The slightly malleable jacket 90 and shield 91 together move over the ridge 80 and under the lip 40, navigating through the now-lengthened gap 85.

Simultaneous rotation of the cable 11 in the direction indicated by the arcuate line H in FIG. 3B and advancement of the cable 11 causes faster compression of the sleeve 21 within the body 13 of the connector 10. Rotation along the direction indicated by the line H corresponds to the helical alignment of the slots 31 in the sidewall 24 of the sleeve 21. As the slots 31 collapse, the rear end 23 of the sleeve 21 moves closer to and rotates slightly with respect to the front end 22 in a clockwise direction, thereby accommodating the rotation along line H of the cable 11.

Rotation and forward movement of the cable 11 is continued until the inner conductor 12 extends just into the coupling nut 20. At this point, the sleeve 21 is moved into the compressed condition fully, in which the slots 31 are completely collapsed in response to the advancement of the cable 11 through the sleeve 21, as seen in FIG. 3B. Advancement of the cable 11 is further continued until the inner conductor 12 is just beyond the coupling nut and the shield 91 is against the shoulder 70 of the inner post 60 and is against the collar 78 of the cylindrical body 13, as in FIG. 3C. Once the cable 11 has been completely inserted into the connector 10 as in FIG. 3C, the lip 40 is flexed and deformed into the deflected condition thereof within the deflection space 47 in response to the jacket 90 and shield 91 having been passed against and beyond the lip 40. In the deflected condition, the back 43 of the lip 40 is against the inner surface 25 of the sleeve 21, the edge 44 of the lip 40 is turned forward toward the front end 22 of the sleeve 21, the edge 44 protrudes slightly into the jacket 90 and engages with the jacket 90 and the face 42 of the lip 40 is in contact with the braided jacket 90.

Figure 3C:
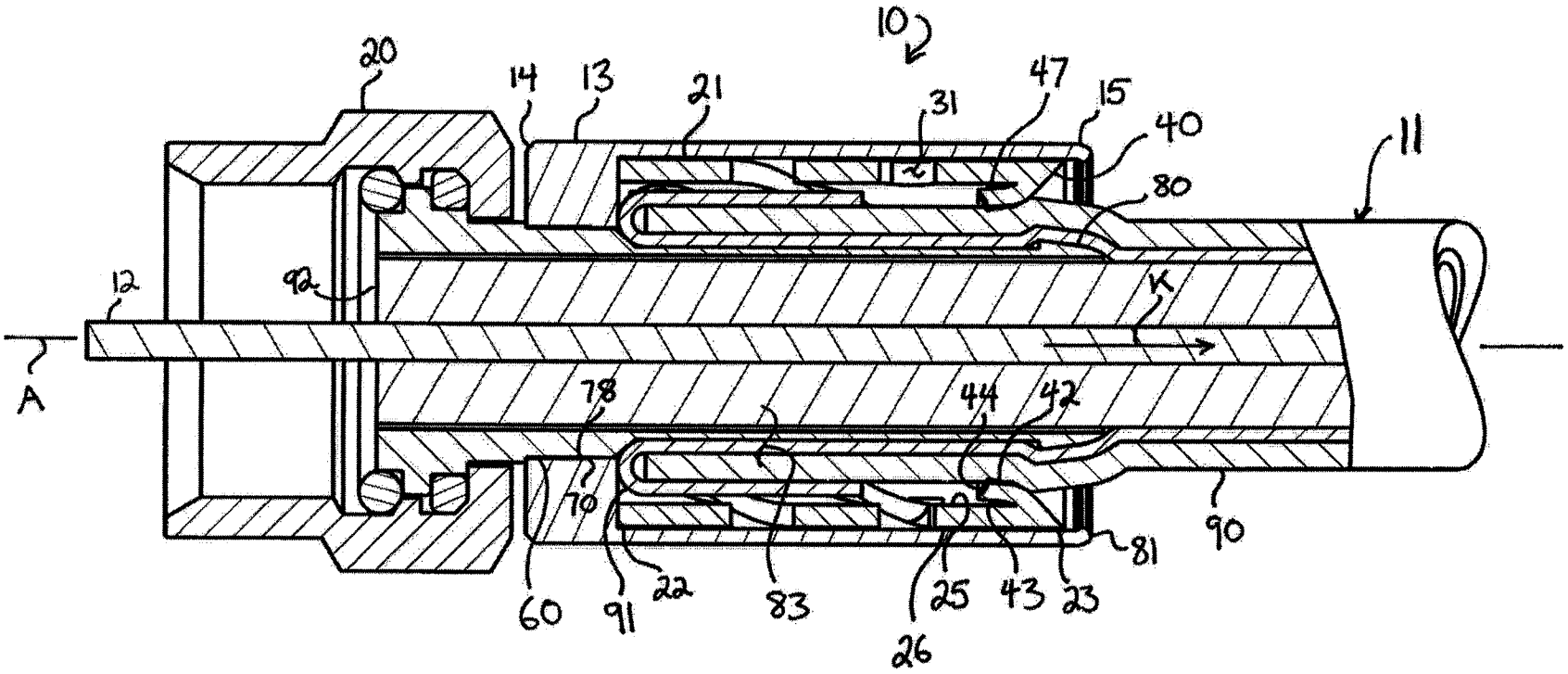

Slight retraction of the cable 11 with respect to the body 13 of the connector 10 along line K moves the cable 11 and sleeve 21 rearwardly, so that the sleeve 21 is in the uncompressed condition seen in FIG. 3C and the rear end 23 of the sleeve 21 is against the mouth 81 of the body 13. The sleeve 21 lengthens, and the slots 31 expand and return to their respective original shapes. The rear end 23 of the sleeve 21 advances back to the rear end 15 of the body 13, and the rear end 23 is there limited from further movement along line K by the inwardly-turned mouth 81, which captures and prevents the rear end 23 of the sleeve 21 from moving out of the rear bore 83.

The slight retraction also causes the lip 40 to turn or buckle inwards slightly, catching and binding with the braids of the jacket 90 in an engagement position. In this arrangement, the lip 40 forms an engagement element binding and permanently coupling the sleeve 21 to the cable 11 and preventing rearward movement or retraction of the cable 11 with respect to the sleeve 21 along line K in FIG. 3C. With the cable 11 coupled to the sleeve 21, and the sleeve 21 prevented from rearward movement beyond the mouth 81 of the body 13, the cable 11 is prevented from removal out of the connector 10 and is prevented from removal off of the inner post 60. The lip 40 is maintained in the deflected condition thereof, engaged with the jacket 90 and crimping the cable 11 against the ridge 80, maintaining the position of the cable 11 with respect to the inner post 60, and maintaining electrical contact and communication between the shield 91 and the inner post 60. Application of the cable 11 to the connector 10 as described herein takes approximately one second, and is accomplished in a single, continuous, fluid forward and twisting motion. The connector 10 is now applied to the cable 11 and ready for operation.

Figure 4A:
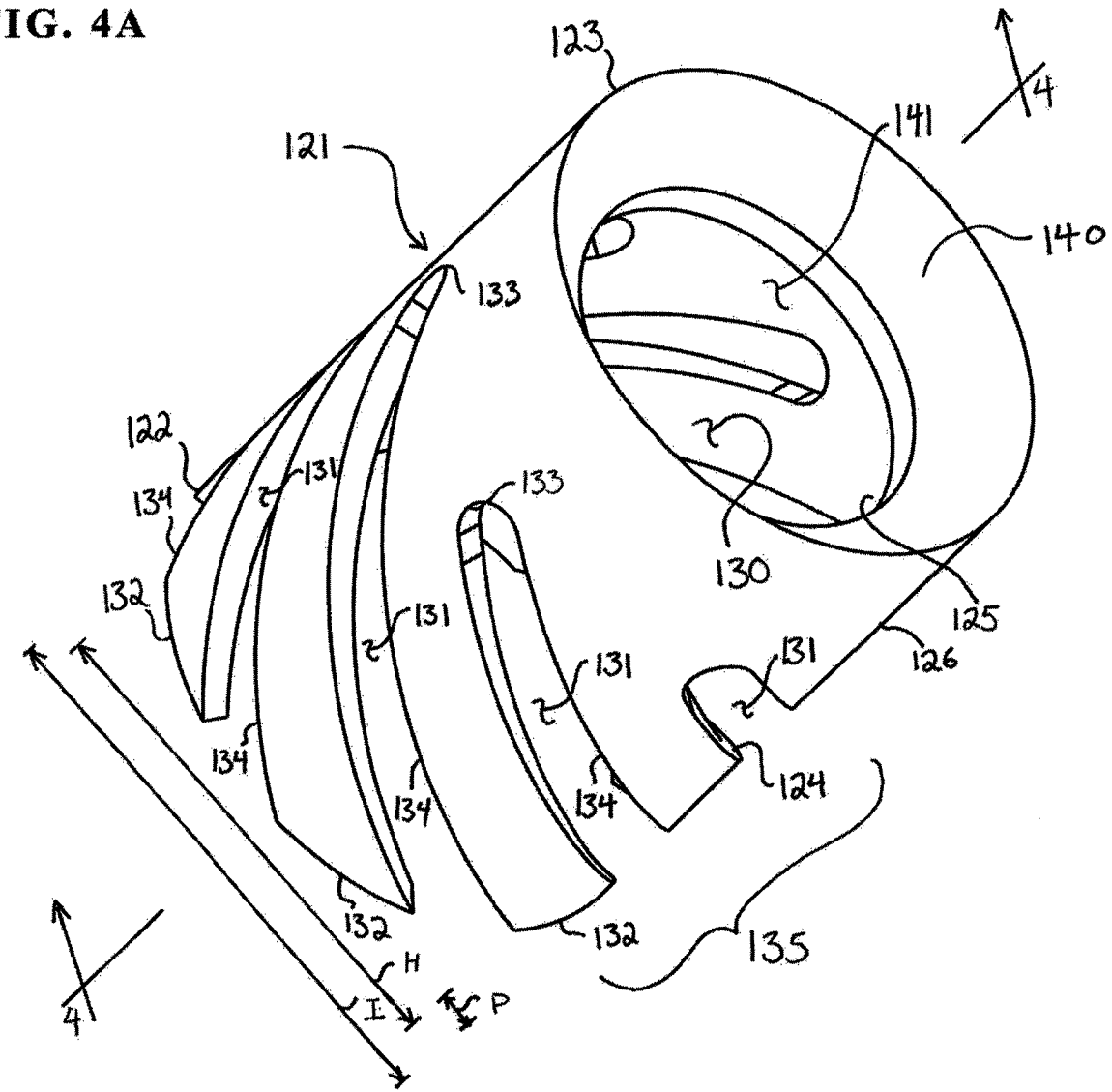
FIG. 4A is a rear perspective view of an embodiment of an inner sleeve of a coaxial cable connector.
Figure 4B:
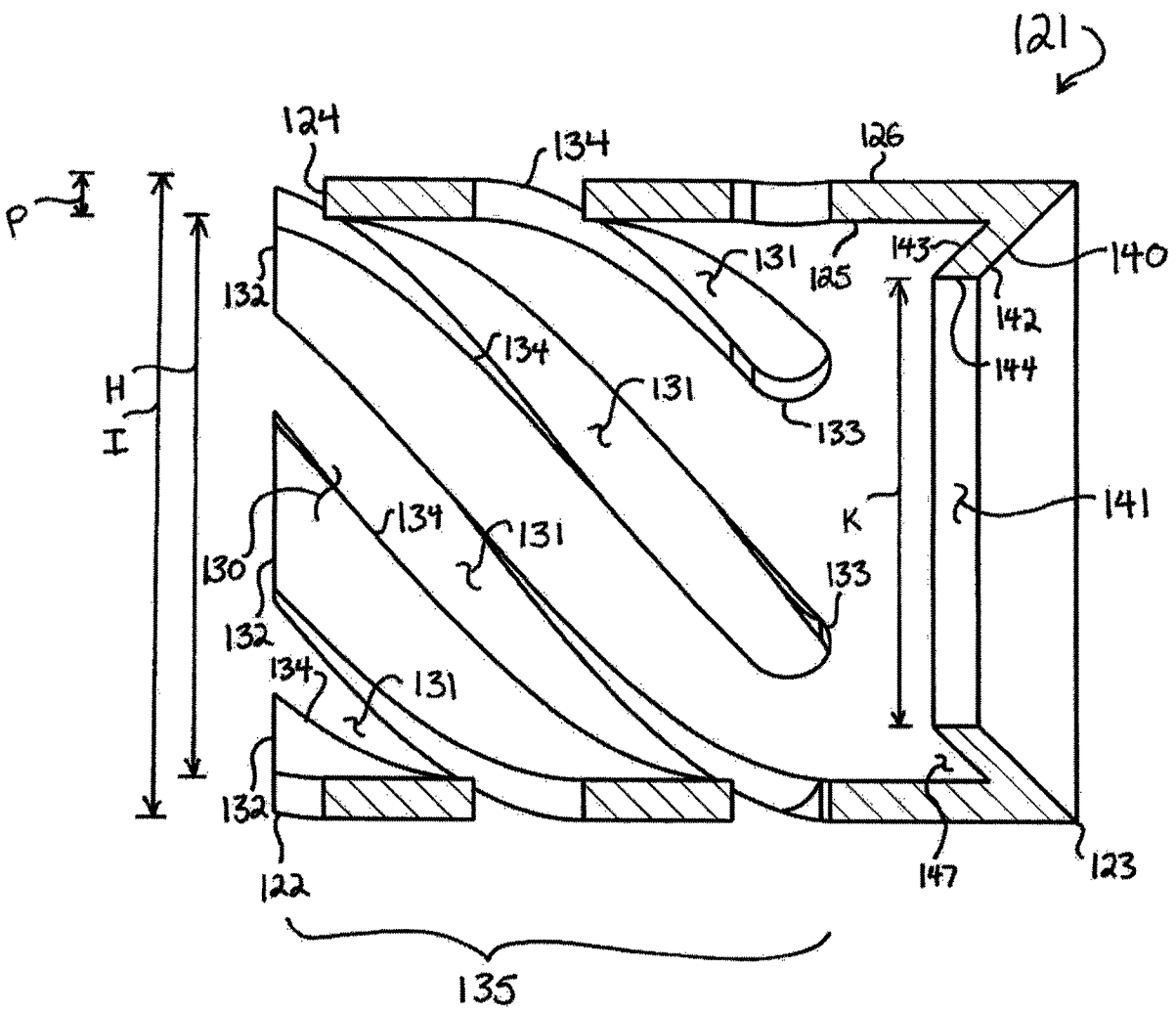
FIG. 4B is a section view of the inner sleeve of FIG. 4A taken along the line 4-4 in FIG. 4A.

An alternate embodiment of an inner sleeve 121 is shown in FIGS. 4A and 4B. The sleeve 121 is for use in a coaxial cable connector 110 (shown in FIG. 5A), which is structurally identical to the coaxial cable connector 110 in every respect other than the application of the sleeve 121 rather than the sleeve 21. As such, the reference characters used to refer to the various structural elements and features of the coaxial cable connector 110 are used herein to refer to the same structural elements and features of the coaxial cable connector 110. One having reasonable skill in the art will readily appreciate that the coaxial cable connectors 10 and 110 are structurally identical but may be different in the way they engage and interact with the sleeves 21 and 121, respectively, which differences will be explained below. Further, because the coaxial cable connector 110 is structurally identical to the coaxial cable connector 110 but for the sleeve 121, the description of the coaxial cable connector 110 below will not include those various identical structural elements and features, but will list them and the constituent parts of the cable 11 instead. Accordingly, the coaxial cable connector 110 includes a coaxial cable 11, inner conductor 12, cylindrical body 13, front and rear end 14 and 15, coupling nut 20, ring portion 45, nut portion 46, outer surface 50, inner surface 51, bore 52, outer surface 53, inner surface 54, gasket 55, gasket 56, inner post 60, front end 61, rear end 62, sidewall 63, inner surface 64, outer surface 65, shoulders 70, 71, 72, 73, and 74, rear collar 75, ridge 76, ridge 80, mouth 81, opening 82, rear bore 83, inner surface 84, gap 85, jacket 90, shield 91, dielectric 92, inner conductor 12, and end 94.

The sleeve 121 is shown in isolation in FIG. 4A. The sleeve 121 has an open front end 122, an opposed open rear end 123, and a cylindrical sidewall 124 extending between the front and rear ends 122 and 123 and including opposed inner and outer surfaces 125 and 126. The inner surface 125 of the sleeve 121 bounds and defines a bore 130 having a consistent inner diameter H through the sleeve 121 from the front end 122 through the rear end 123, which bore 130 is structured to closely receive the coaxial cable 11. The outer surface 126 has an outer diameter I which is larger than the inner diameter H by a thickness P of the sidewall 24.

Figure 5A:
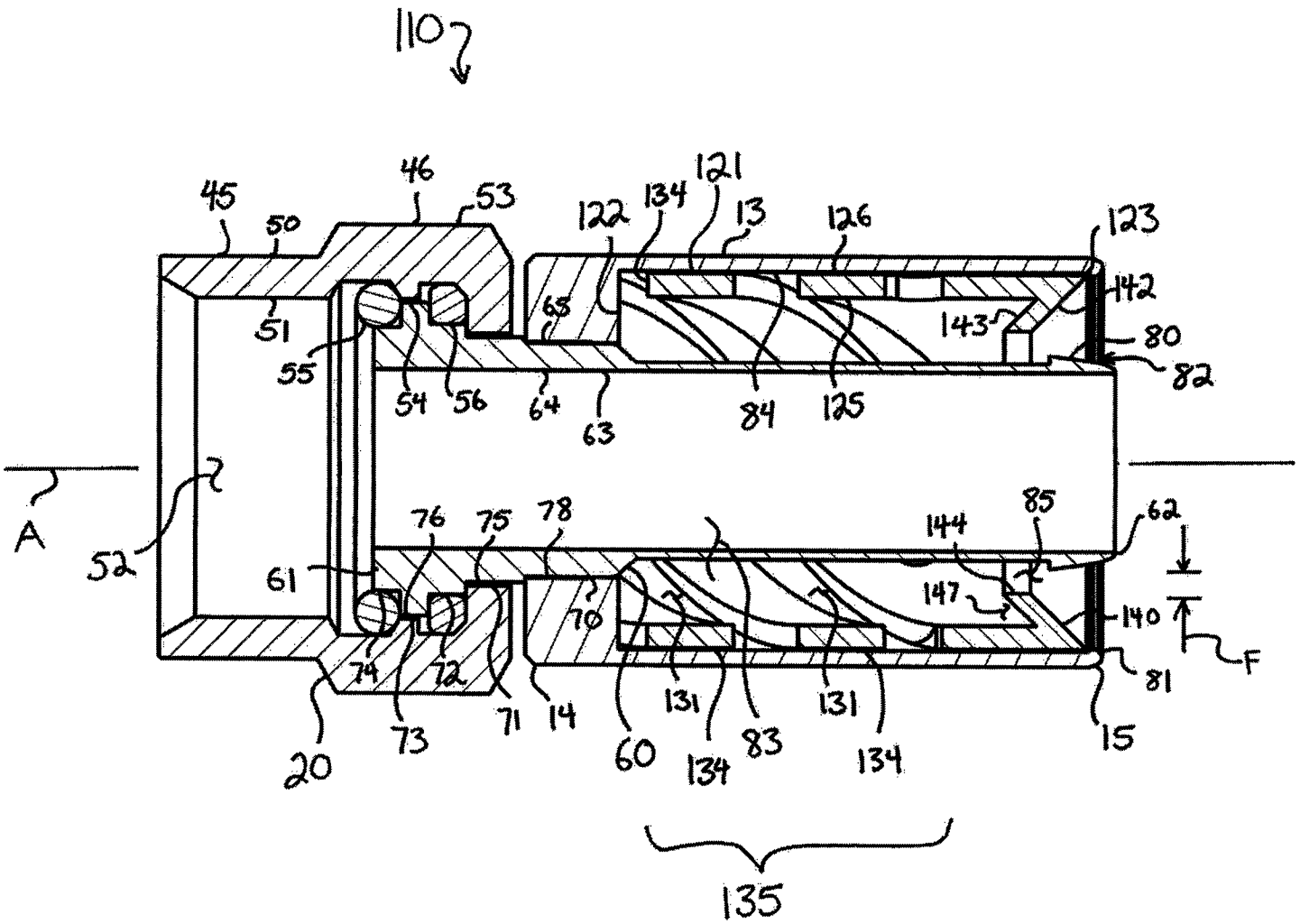
FIGS. 5A-5C are section views taken along a line similar to the line 1-1 in FIG. 1, showing a sequence of steps of applying the coaxial cable to the coaxial cable connector with the inner sleeve of FIG. 4A.
Figure 5B:
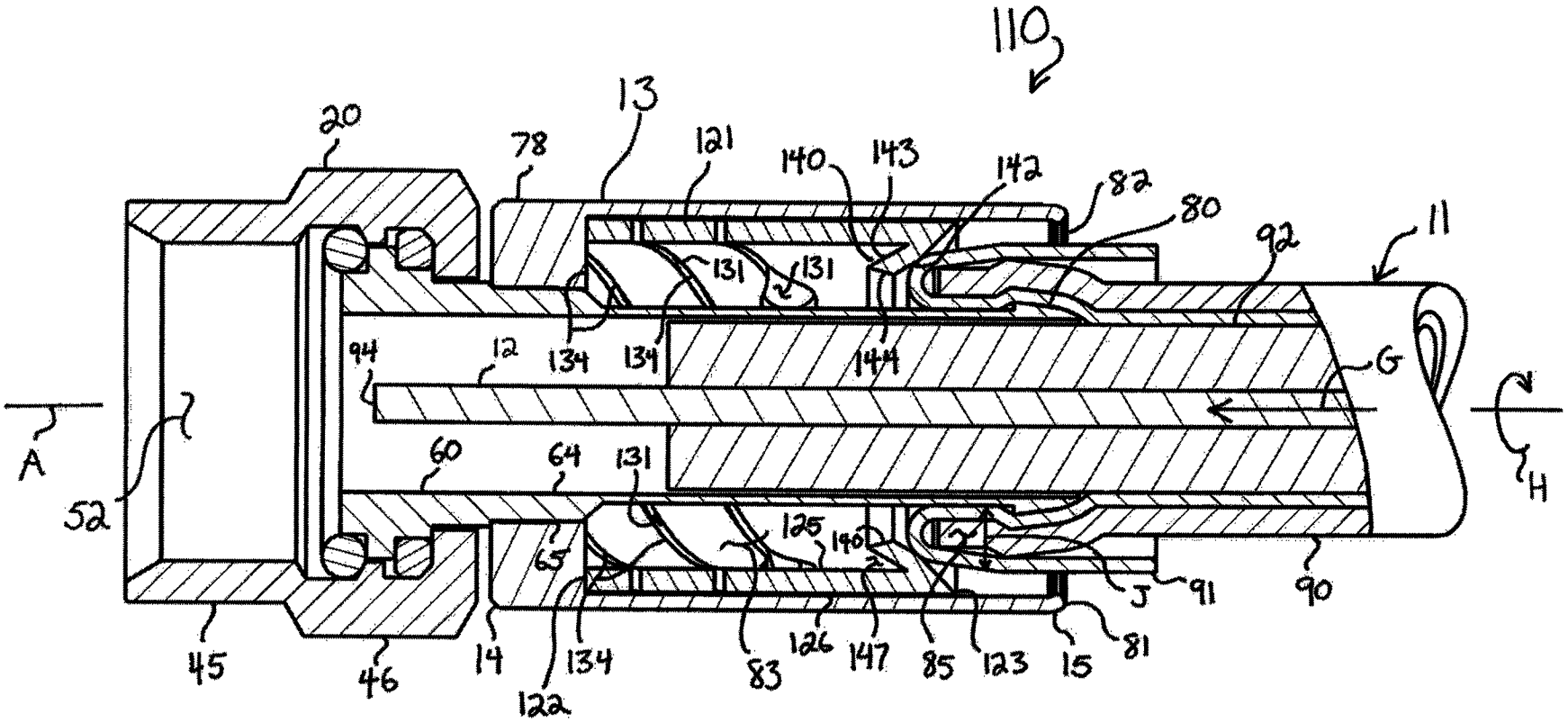

The sleeve 121 has a compression assembly 135 formed integrally in the sidewall 124, and including a plurality of helical slots 131 formed through the sidewall 124, defining diagonal fingers 134 in the sidewall 124 that extend fully to the front end 122, which is severed by the slots 131 between the fingers 134. The slots 131 between the fingers 134 allow the compression assembly 135 to move between an uncompressed condition (as shown in FIGS. 4A, 4B, and 5A) and a compressed condition (as shown in FIG. 5B) in response to axial compression of the cable 11 into the connector 110 so as to engage the cable 11 to create a secure coupling between the connector and cable 11. Each slot 131 is aligned helically in the sidewall 124 of the sleeve 121, disposed in a counter-clockwise rotational direction from a location generally intermediate with respect to the front and rear ends 122 and 123 to the front end 122. One having reasonable skill in the art will readily appreciate that the slots 131 could be aligned in an opposite direction, namely, in a clockwise direction. Each finger 134 has a forward end 132 proximate to the front end 122 of the sleeve 121, and an opposed rearward end 133 which is inboard of the rear end 123 of the sleeve 121 at a generally intermediate location with respect to the front and rear ends 122 and 123, and which is angularly offset with respect to the forward end 132 of the respective finger 134. When the cable 11 is introduced into the bore 130 of the sleeve 121, the slots 131 collapse in response to axial compression of the sleeve 121, with the fingers 134 moving together.

FIG. 4B is a section view taken along the line 4-4 in FIG. 4A. A lip 140, shown in FIG. 4B, and formed on the inner surface 125, bounds and defines an opening 141 into the bore 130 from the rear end 123 which has a reduced diameter identified by the reference character K in FIG. 4B. The lip 140 is a continuous annular extension of the sidewall 124 projecting radially inwardly and forwardly toward the front end 122 of the sleeve 121. The lip 140 is a pawl, or engagement element, for engagement with the cable 11 that moves between an initial, raised condition, in which the lip 140 is ready to receive application of the cable 11, a deflected condition in response to application of the cable 11 to the connector 110 in which the lip 140 accommodates the cable 11, and an interference condition in response to retraction of the cable 11 from the connector 110 in which the lip 140 engages the cable 11 and prevents removal of the cable 11 from the sleeve 121. As will be explained, the lip 140 moves into the deflected condition and the sleeve 121 compresses axially in response to the cable 11 being applied to the sleeve 121 so as to engage the cable 11, consistent with the mechanism of a pawl. A pawl is a pivoted lever adapted to engage with an element to allow forward movement of the element and prevent backward movement of the element.

Still referring to FIG. 4B, the lip 140 has a continuous inclined face 142 directed toward the rear end 123 of the sleeve and an opposed continuous back 143 directed toward the front end 122. The face 142 and back 143 meet at a flat, annular edge 144 which extends continuously around the lip 140 and is directed radially inward. The lip 140 is constructed of a material or combination of materials having semi-rigid, flexible, and elastic material characteristics, allowing the lip 140 to flex radially outward along a living hinge at the inner surface 125 toward the sidewall 124, resist flexing radially inward toward the center of the sleeve 121, and return to its original position after flexing. In this way, the lip 140 operates as a pawl to deflect and allow forward movement and to resist rearward movement. An annular deflection space 147 lies between the back 143 and the inner surface 125 of the sidewall 124 to accommodate the lip 140 as it flexes radially outwardly into the deflected condition.

FIG. 5A is a section view of the connector 110 taken along a line similar to the line 3-3 bisecting the connector 10 in FIG. 1, showing the connector 110 with the sleeve 121 carried in the body 13 of the connector 110. The body 13 and the coupling nut 20 are carried on the electrically conductive inner post 60.

The sleeve 121 is fit between the collar 78 at the front end 14 of the body 13 and the mouth 81 at the rear end 15, and the full length of the outer surface 126 of the sleeve 121 is received in juxtaposition against the inner surface 84 of the body 13 in a frictional-fit engagement preventing relative rotational movement of the sleeve 121 within the collar 13. The collar 78 at the front end 14 of the body 13 prevents forward axial movement of the front end 122 of the sleeve 121 toward the coupling nut 20, and the interaction of the rear end 123 of the sleeve 121 against the inwardly-turned mouth 81 prevents axial movement of the rear end 123 out of the rear bore 83. The sleeve 121 is thus disposed between the inner surface 84 of the body 13 and the outer surface 65 of the inner post 60, and the lip 140 of the sleeve 121 is opposed from and slightly inboard with respect to the ridge 80, so that the ridge 80 is disposed between the lip 140 and the mouth 81 when the sleeve 121 is in the uncompressed condition thereof. The edge 144 of the lip 140 cooperates with the annular ridge 80 at the rear end 62 of the inner post 60 to define the annular gap 85 forming an entrance to the rear bore 83. The annular gap 85 has a width F between the ridge 80 and the lip 140, as shown in FIG. 5A. The width F corresponds to a tight clearance between the ridge 80 and the opposed lip 140, so that the cable 11 encounters both the lip 140 and ridge 80 nearly concurrently when applied to the connector 10.

With reference now to FIG. 5B, to apply the connector 110 onto the cable 11, the cable 11 is stripped and prepared according to well-known and conventional techniques, including stripping off a portion of a jacket 90 and folding back a flexible shield 91 over the jacket 90 to expose a dielectric 92 encircling the inner conductor 12 at an exposed end 94 of the coaxial cable 11. The end 94 of the cable 11 is introduced into the connector 110 by taking up the cable 11, such as by hand, and aligning the inner conductor 12 with the longitudinal axis A, presenting the end 94 to the opening 82, and passing the end 94 into the rear bore 83 along a direction generally indicated by the arrowed line G in FIG. 5B. Tools are not required for the application and installation of the connector 110 onto the cable 11, as the connector 10 can be fixed on the cable 11 by hand alone. The inner conductor 12 and the dielectric 92 enter the rear bore 83 inside the inner post 60 against the inner surface 64 of the inner post 60. The shield 91, which is curled back over the jacket 90, moves against and over the ridge 80, over the outer surface 65 of the inner post 60, and encounters the face 142 of the lip 140. The lip 140 is initially directed radially inward in an interference condition. The jacket 90, and the shield 91 folded back over the jacket 90, have a thickness J shown in FIG. 5B, which is greater than the width F (shown in FIG. 5A) of the annular gap 85 between the lip 140 and ridge 80, so that the lip 140 and the ridge 80 cooperate to define an interference to the advancement of the cable 11 along the direction of arrowed line G.

Application of an increased amount of axial force along arrowed line G causes the cable 11 to advance through the annular gap 85, deflecting the lip 140 along line G and radially outward toward the deflected condition of the lip 140, out of the interference condition, as seen in FIG. 5B. The flexible material characteristic of the lip 140 allows the lip 140 to deform slightly in response to the increased application of axial force imparted by advancement of the cable 11 along line G. The back 143 of the lip 140 is moved closer to the inner surface 125 of the sleeve, reducing the deflection space 147 and directing the edge 144 toward the front end 14 of the body 13.

As the lip 140 moves toward the deflected condition, the sleeve 121, to which the lip 140 is integrally formed, also begins to compress in the axial direction, as shown in FIG. 5B, in response to continued forward application of the cable 11 into the connector 10. The slots 131 and fingers 134 provide the sidewall 124 of the sleeve 121 with axial compression characteristics to accommodate the compression. As the sleeve 121 compresses, the slots 131 collapse and the fingers 134 spaced apart by the slots 131 come together, reducing the length of the sleeve 121 between the front and rear ends 122 and 123. Compression of the sleeve 121 causes the lip 140 to move down the body 13 toward the front end 14 and away from the ridge 80 of the inner post 60. Thus, as the cable 11 moves into the connector 110, the sleeve 121 compresses and the lip 140 on the sleeve 121 yields or deflects. The tight clearance between the lip 140 and the ridge 80 is relaxed because the lip 140 is moved out of its original, opposed position with respect to the ridge 80. The slightly malleable jacket 90 and shield 91 together move over the ridge 80 and under the lip 140, navigating through the now-lengthened gap 85.

Simultaneous rotation of the cable 11 in the direction indicated by the arcuate line H in FIG. 5B and advancement of the cable 11 causes faster compression of the sleeve 121 within the body 13 of the connector 10. Rotation along the direction indicated by the line H corresponds to the helical alignment of the slots 131 in the sidewall 124 of the sleeve 121. As the slots 131 collapse, the rear end 123 of the sleeve 121 moves closer to and rotates slightly with respect to the front end 122 in a clockwise direction, thereby accommodating the rotation along line H of the cable 11.

Rotation and forward movement of the cable 11 is continued until the inner conductor 12 extends just into the coupling nut 20. At this point, the sleeve 121 is moved into the compressed condition fully, in which the slots 131 are completely collapsed in response to the advancement of the cable 11 through the sleeve 121, as seen in FIG. 5B. Advancement of the cable 11 is further continued until the inner conductor 12 is just beyond the coupling nut 20 and the shield 91 of the cable 11 is against the shoulder 70 of the inner post 60 and is against the collar 78 of the cylindrical body 13, as in FIG. 5C. Once the cable 11 has been completely inserted into the connector 10 as in FIG. 5C, the lip 140 is flexed and deformed into the deflected condition thereof within the deflection space 147 in response to the jacket 90 and shield 91 having been passed against and beyond the lip 140. In the deflected condition, the back 143 of the lip 140 is against the inner surface 125 of the sleeve 121, the edge 144 of the lip 140 is turned forward toward the front end 122 of the sleeve 121, the edge 144 protrudes slightly into the jacket 90 and engages with the jacket 90, and the face 142 of the lip 140 is in contact with the braided jacket 90.

Figure 5C:
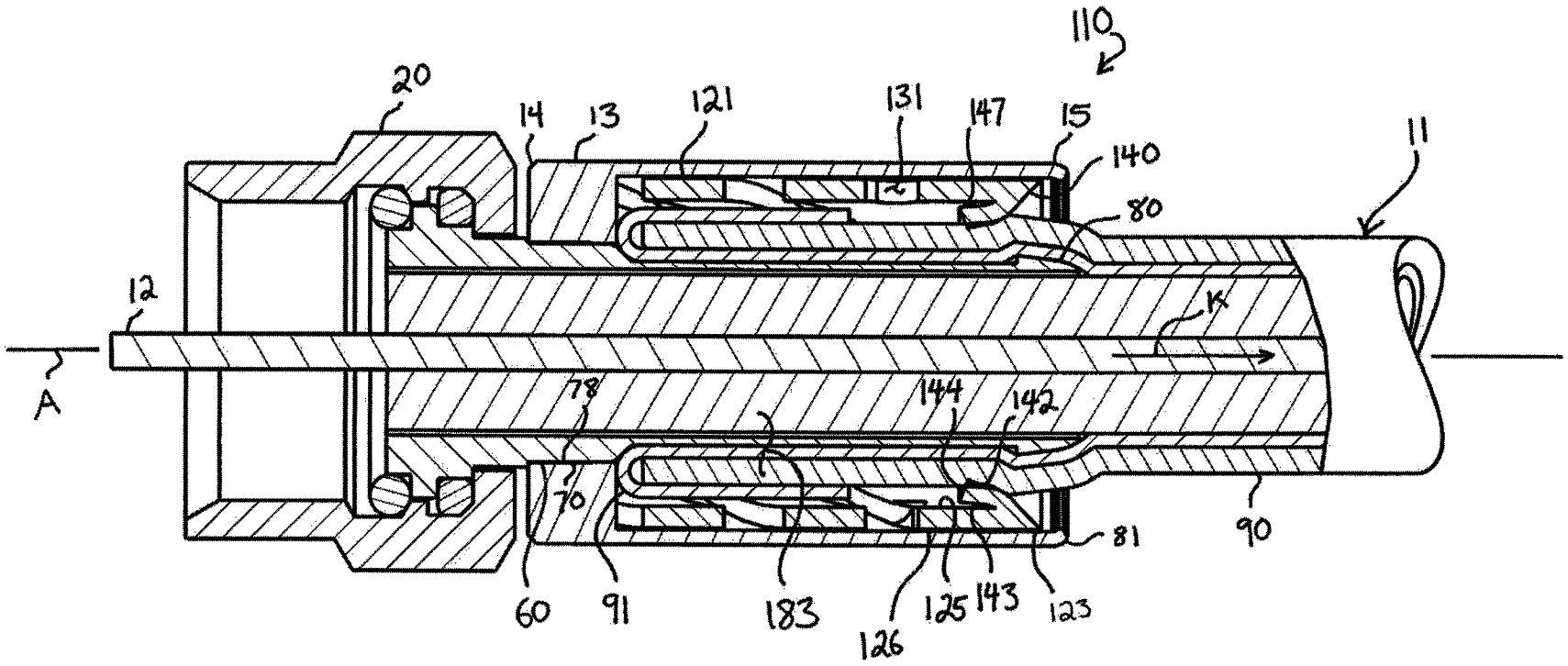

Slight retraction of the cable 11 with respect to the body 13 of the connector 10 along line K moves the cable 11 and sleeve 121 rearwardly, so that the sleeve 121 is in the uncompressed condition seen in FIG. 5C and the rear end 123 of the sleeve 121 is against the mouth 81 of the body 13. The sleeve 121 lengthens, and the slots 131 expand and return to their respective original shapes. The rear end 123 of the sleeve 121 advances back to the rear end 15 of the body 13, and the rear end 123 is there limited from further movement along line K by the inwardly-turned mouth 81, which captures and prevents the rear end 123 of the sleeve 121 from moving out of the rear bore 83.

The slight retraction also causes the lip 140 to turn or buckle inwards slightly, catching and binding with the braids of the jacket 90 in an engagement position. In this arrangement, the lip 140 forms an engagement element binding and permanently coupling the sleeve 121 to the cable 11 and preventing rearward movement or retraction of the cable 11 with respect to the sleeve 121 along line K in FIG. 5C. With the cable 11 coupled to the sleeve 121, and the sleeve 121 prevented from rearward movement beyond the mouth 81 of the body 13, the cable 11 is prevented from removal out of the connector 110 and is prevented from removal off of the inner post 60. The lip 140 is maintained in the deflected condition thereof, engaged with the jacket 90 and crimping the cable 11 against the ridge 80, maintaining the position of the cable 11 with respect to the inner post 60, and maintaining electrical contact and communication between the shield 91 and the inner post 60. Application of the cable 11 to the connector 110 as described herein takes approximately one second, and is accomplished in a single, continuous, fluid forward and twisting motion. The connector 110 is now applied to the cable 11 and ready for operation.

Figure 6A:
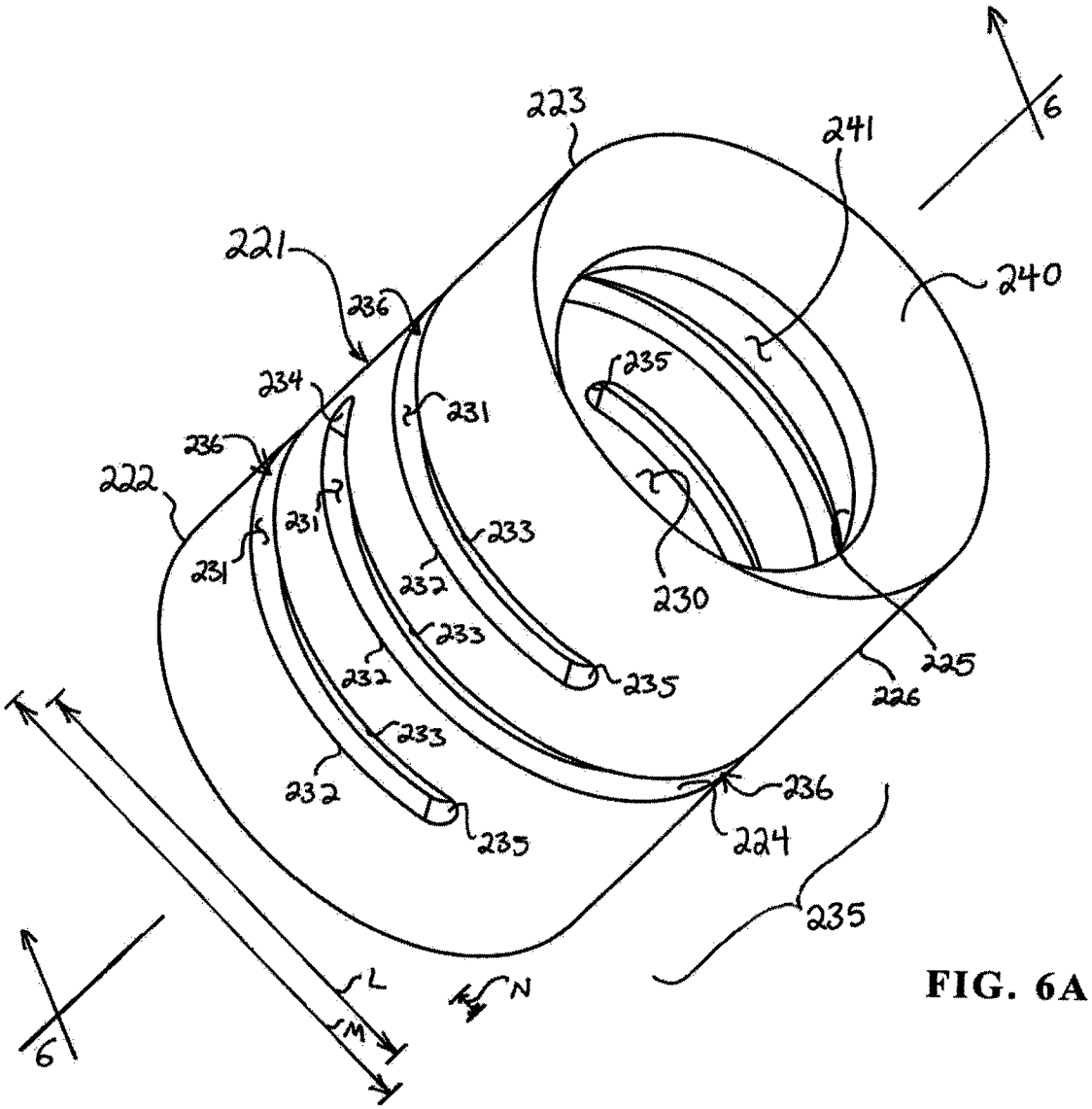
FIG. 6A is a rear perspective view of an embodiment of an inner sleeve of a coaxial cable connector.

An alternate embodiment of an inner sleeve 221 is shown in FIGS. 6A and B. The sleeve 221 is for use in a coaxial cable connector 210 (shown in FIG. 7A), which is structurally identical to the coaxial cable connectors 10 and 110 in every respect other than the application of the sleeve 221 rather than the sleeves 21 and 121, respectively. As such, the reference characters used to refer to the various structural elements and features of the coaxial cable connectors 10 and 110 are used herein to refer to the same structural elements and features of the coaxial cable connector 210. One having reasonable skill in the art will readily appreciate that the coaxial cable connectors 10, 110, and 210 are structurally identical but may be different in the way they engage and interact with the sleeves 21, 121, and 221, respectively, which differences will be explained below. Further, because the coaxial cable connector 210 is structurally identical to the coaxial cable connector 110 but for the sleeve 221, the description of the coaxial cable connector 210 below will not include those various identical structural elements and features, but will list them and the constituent parts of the cable 11 instead. Accordingly, the coaxial cable connector 210 includes a coaxial cable 11, inner conductor 12, cylindrical body 13, front and rear end 14 and 15, coupling nut 20, ring portion 45, nut portion 46, outer surface 50, inner surface 51, bore 52, outer surface 53, inner surface 54, gasket 55, gasket 56, inner post 60, front end 61, rear end 62, sidewall 63, inner surface 64, outer surface 65, shoulders 70, 71, 72, 73, and 74, rear collar 75, ridge 76, ridge 80, mouth 81, opening 82, rear bore 83, inner surface 84, gap 85, jacket 90, shield 91, dielectric 92, inner conductor 12, and end 94.

The sleeve 221 is shown in isolation in FIG. 6A. The sleeve 221 has an open front end 222, an opposed open rear end 223, and a cylindrical sidewall 224 extending between the front and rear ends 222 and 223 and including opposed inner and outer surfaces 225 and 226. The inner surface 225 of the sleeve 221 bounds and defines a bore 230 having a consistent inner diameter L through the sleeve 221 from the front end 222 through the rear end 223, which bore 230 is structured to closely receive the coaxial cable 11. The outer surface 226 has an outer diameter M which is larger than the inner diameter L by a thickness N of the sidewall 24.

The sleeve 221 has a compression assembly 235 formed integrally in the sidewall 224, and including a plurality of circumferential slots 231 formed through the sidewall 224 around a quasi-circular portion of the sidewall 224, or, in other words, around a less-than-complete circumferential portion of the sidewall 224. The slots are transverse with respect to the longitudinal axis A shown in FIGS. 7A-7C, and each slot 231 is offset circumferentially from neighboring slots between the front and rear ends 222 and 223 of the sleeve 221. In FIG. 6A, three slots 231 are shown; one having ordinary skill in the art will readily appreciate that a lesser or greater number of slots 231 may be formed in the sidewall 224. The slots 231 are thin and each have an elongate front side 232, disposed toward the front end 222 of the sleeve 221, and an opposed elongate rear side 233, disposed toward the rear end 223 of the sleeve 221. The front and rear sides 232 and 233 extend between opposed ends 234 and 235. Moreover, each of the slots 231 have midsections 236 located generally intermediately between the ends 234 and 235 of the respective slot 231, which midsection 236 is located generally between the ends 234 and 235 of a proximate slot 231. The slots 231 allow the compression assembly 235 to move between an uncompressed condition (as shown in FIGS. 6A, 4B, and 5A) and a compressed condition (as shown in FIG. 7B) in response to axial compression of the cable 11 into the connector 210 so as to engage the cable 11 to create a secure coupling between the connector and cable 11.

Each slot 231 is aligned circumferentially in the sidewall 224 of the sleeve 221, disposed in a counter-clockwise rotational direction from a location generally intermediate with respect to the front and rear ends 222 and 223 to the front end 222. When the cable 11 is introduced into the bore 230 of the sleeve 221, the slots 231 collapse in response to axial compression of the sleeve 221, with the front and rear sides 232 and 233 of each slot 231 at the midsection 236 moving together.

Figure 6B:
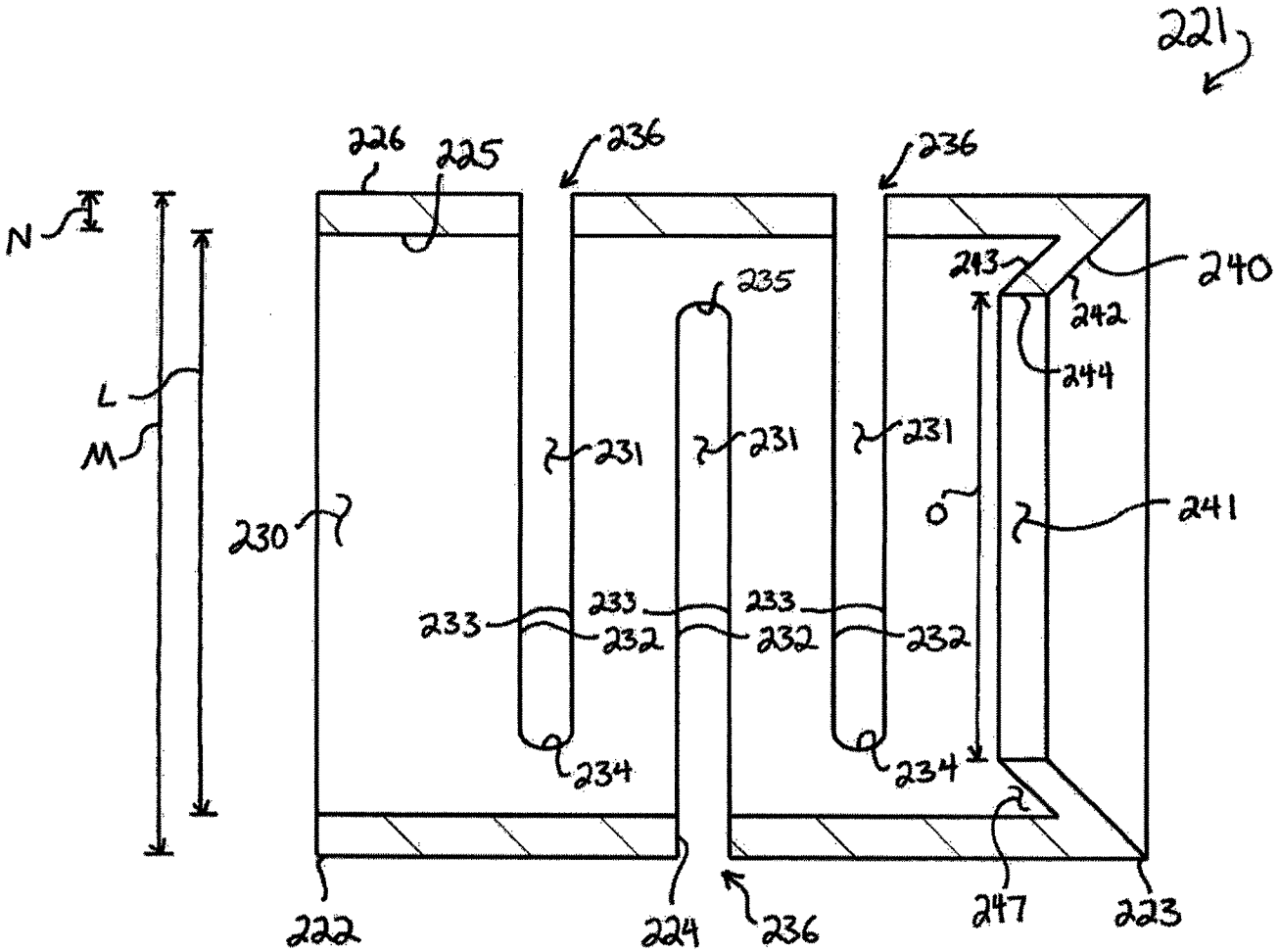
FIG. 6B is a section view of the inner sleeve of FIG. 6A taken along the line 6-6 in FIG. 6A.

FIG. 6B is a section view taken along the line 6-6 in FIG. 6A. A lip 240, shown in FIG. 6B, and formed on the inner surface 225, bounds and defines an opening 241 into the bore 230 from the rear end 223 which has a reduced diameter identified by the reference character K in FIG. 6B. The lip 240 is a continuous annular extension of the sidewall 224 projecting radially inwardly and forwardly toward the front end 222 of the sleeve 221. The lip 240 is a pawl, or engagement element, for engagement with the cable 11 that moves between an initial, raised condition, in which the lip 240 is ready to receive application of the cable 11, a deflected condition in response to application of the cable 11 to the connector 210 in which the lip 240 accommodates the cable 11, and an interference condition in response to retraction of the cable 11 from the connector 210 in which the lip 240 engages the cable 11 and prevents removal of the cable 11 from the sleeve 221. As will be explained, the lip 240 moves into the deflected condition and the sleeve 221 compresses axially in response to the cable 11 being applied to the sleeve 221 so as to engage the cable 11, consistent with the mechanism of a pawl. A pawl is a pivoted lever adapted to engage with an element to allow forward movement of the element and prevent backward movement of the element.

Still referring to FIG. 6B, the lip 240 has a continuous inclined face 242 directed toward the rear end 223 of the sleeve and an opposed continuous back 243 directed toward the front end 222. The face 242 and back 243 meet at a flat, annular edge 244 which extends continuously around the lip 240 and is directed radially inward. The lip 240 is constructed of a material or combination of materials having semi-rigid, flexible, and elastic material characteristics, allowing the lip 240 to flex radially outward along a living hinge at the inner surface 225 toward the sidewall 224, resist flexing radially inward toward the center of the sleeve 221, and return to its original position after flexing. In this way, the lip 240 operates as a pawl to deflect and allow forward movement and to resist rearward movement. An annular deflection space 247 lies between the back 243 and the inner surface 225 of the sidewall 224 to accommodate the lip 240 as it flexes radially outwardly into the deflected condition.

Figure 7A:
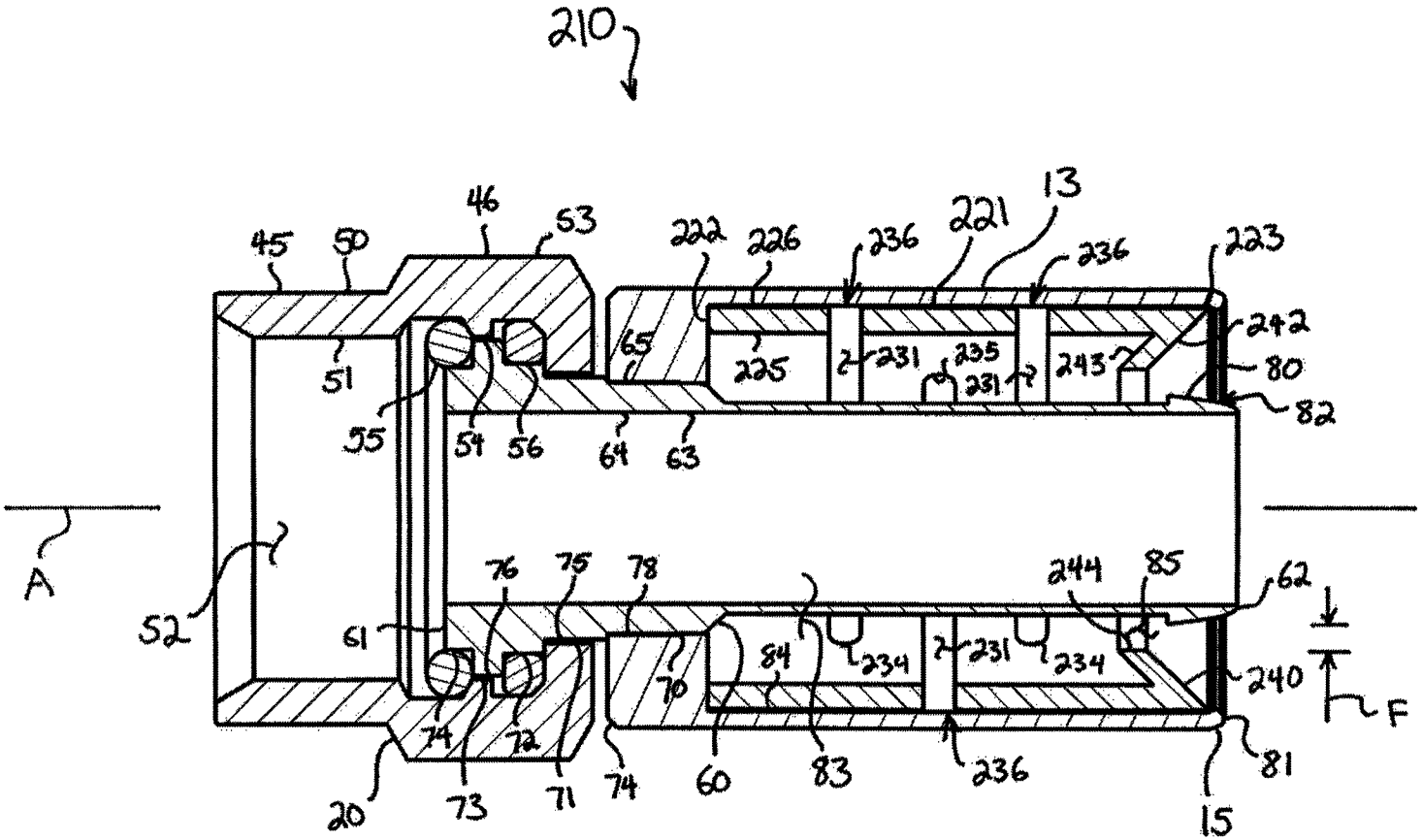
FIGS. 7A-7C are section views taken along a line similar to the line 1-1 in FIG. 1, showing a sequence of steps of applying the coaxial cable to the coaxial cable connector with the inner sleeve of FIG. 6A.
Figure 7B:
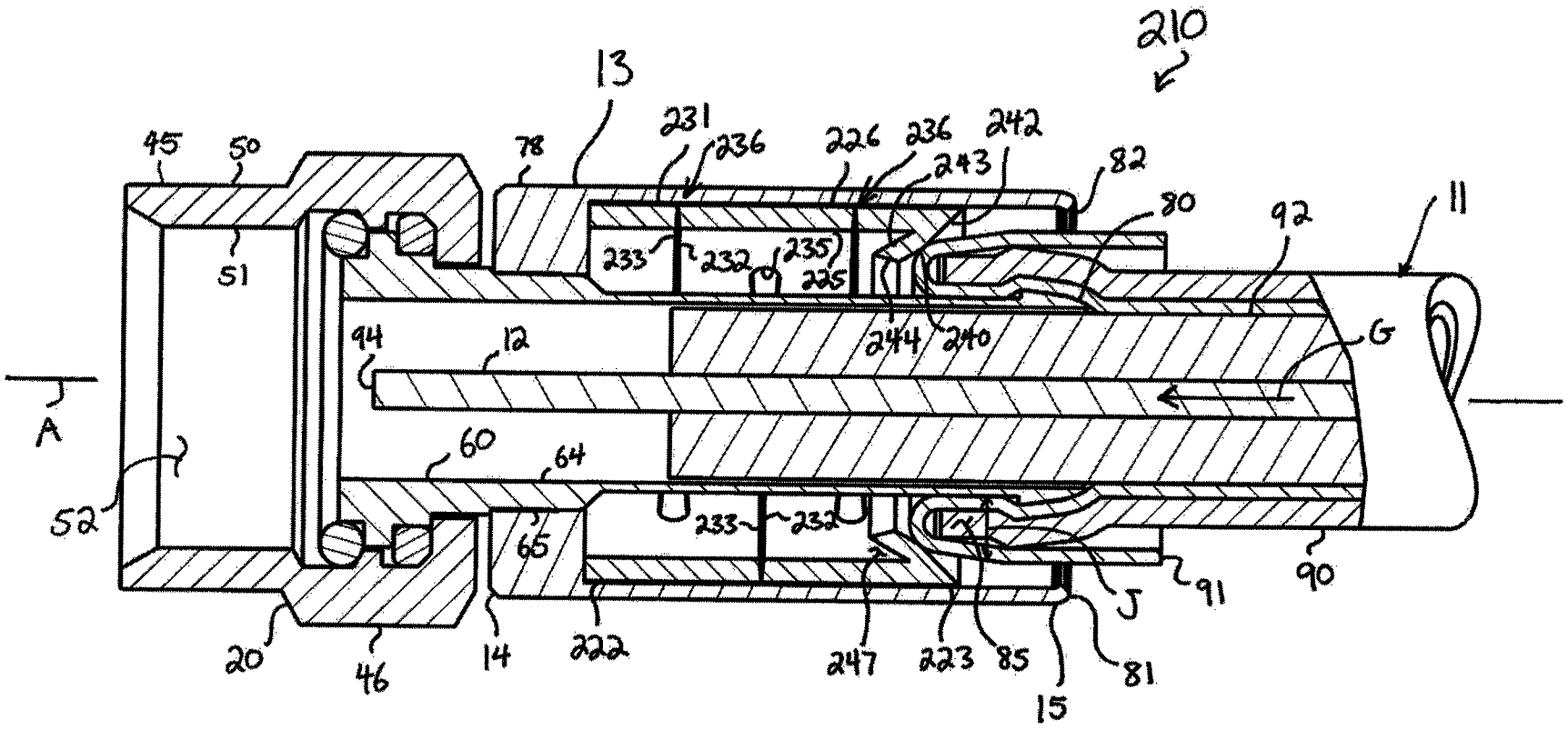

FIG. 7A is a section view of the connector 210 taken along a line similar to the line 3-3 bisecting the connector 10 in FIG. 1, showing the connector 210 with the sleeve 221 carried in the body 13 of the connector 210. The body 13 and the coupling nut 20 are carried on the electrically conductive inner post 60.

The sleeve 221 is fit between the collar 78 at the front end 14 of the body 13 and the mouth 81 at the rear end 15, and the full length of the outer surface 226 of the sleeve 221 is received in juxtaposition against the inner surface 84 of the body 13 in a frictional-fit engagement preventing relative rotational movement of the sleeve 221 within the collar 13. The collar 78 at the front end 14 of the body 13 prevents forward axial movement of the front end 222 of the sleeve 221 toward the coupling nut 20, and the interaction of the rear end 223 of the sleeve 221 against the inwardly-turned mouth 81 prevents axial movement of the rear end 223 out of the rear bore 83. The sleeve 221 is thus disposed between the inner surface 84 of the body 13 and the outer surface 65 of the inner post 60, and the lip 240 of the sleeve 221 is opposed from and slightly inboard with respect to the ridge 80, so that the ridge 80 is disposed between the lip 240 and the mouth 81 when the sleeve 221 is in the uncompressed condition thereof. The edge 244 of the lip 240 cooperates with the annular ridge 80 at the rear end 62 of the inner post 60 to define the annular gap 85 forming an entrance to the rear bore 83. The annular gap 85 has a width O between the ridge 80 and the lip 240, as shown in FIG. 7A. The width O corresponds to a tight clearance between the ridge 80 and the opposed lip 240, so that the cable 11 encounters both the lip 240 and ridge 80 nearly concurrently when applied to the connector 10.

With reference now to FIG. 7B, to apply the connector 210 onto the cable 11, the cable 11 is stripped and prepared according to well-known and conventional techniques, including stripping off a portion of a jacket 90 and folding back a flexible shield 91 over the jacket 90 to expose a dielectric 92 encircling the inner conductor 12 at an exposed end 94 of the coaxial cable 11. The end 94 of the cable 11 is introduced into the connector 210 by taking up the cable 11, such as by hand, and aligning the inner conductor 12 with the longitudinal axis A, presenting the end 94 to the opening 82, and passing the end 94 into the rear bore 83 along a direction generally indicated by the arrowed line G in FIG. 7B. Tools are not required for the application and installation of the connector 210 onto the cable 11, as the connector 10 can be fixed on the cable 11 by hand alone. The inner conductor 12 and the dielectric 92 enter the rear bore 83 inside the inner post 60 against the inner surface 64 of the inner post 60. The shield 91, which is curled back over the jacket 90, moves against and over the ridge 80, over the outer surface 65 of the inner post 60, and encounters the face 242 of the lip 240. The lip 240 is initially directed radially inward in an interference condition. The jacket 90, and the shield 91 folded back over the jacket 90, have a thickness J shown in FIG. 7B, which is greater than the width F (shown in FIG. 7A) of the annular gap 85 between the lip 240 and ridge 80, so that the lip 240 and the ridge 80 cooperate to define an interference to the advancement of the cable 21 along the direction of arrowed line G.

Application of an increased amount of axial force along arrowed line G causes the cable 11 to advance through the annular gap 85, deflecting the lip 240 along line G and radially outward toward the deflected condition of the lip 240, out of the interference condition, as seen in FIG. 7B. The flexible material characteristic of the lip 240 allows the lip 240 to deform slightly in response to the increased application of axial force imparted by advancement of the cable 11 along line G. The back 243 of the lip 240 is moved closer to the inner surface 225 of the sleeve, reducing the deflection space 247 and directing the edge 244 toward the front end 14 of the body 13.

As the lip 240 moves toward the deflected condition, the sleeve 221, to which the lip 240 is integrally formed, also begins to compress in the axial direction, as shown in FIG. 7B, in response to continued forward application of the cable 11 into the connector 10. The slots 231 provide the sidewall 224 of the sleeve 221 with axial compression characteristics to accommodate the compression. As the sleeve 221 compresses, the slots 231 collapse and the front and rear sides 232 and 233 of the slots 231 at the midsections 236 come together, reducing the length of the sleeve 221 between the front and rear ends 222 and 223. Compression of the sleeve 221 causes the lip 240 to move down the body 13 toward the front end 14 and away from the ridge 80 of the inner post 60. Thus, as the cable 11 moves into the connector 210, the sleeve 221 compresses and the lip 240 on the sleeve 221 yields or deflects. The tight clearance between the lip 240 and the ridge 80 is relaxed because the lip 240 is moved out of its original, opposed position with respect to the ridge 80. The slightly malleable jacket 90 and shield 91 together move over the ridge 80 and under the lip 240, navigating through the now-lengthened gap 85.

Forward movement of the cable 11 is continued until the inner conductor 12 extends just into the coupling nut 20. At this point, the sleeve 221 is moved into the compressed condition fully, in which the slots 231 are completely collapsed in response to the advancement of the cable 11 through the sleeve 221, as seen in FIG. 7B. Advancement of the cable 11 is further continued until the inner conductor 12 is just beyond the coupling nut 20 and the shield 91 of the cable 11 is against the shoulder 70 of the inner post 60 and is against the collar 78 of the cylindrical body 13, as in FIG. 7C. Once the cable 11 has been completely inserted into the connector 10 as in FIG. 7C, the lip 240 is flexed and deformed into the deflected condition thereof within the deflection space 247 in response to the jacket 90 and shield 91 having been passed against and beyond the lip 240. In the deflected condition, the back 243 of the lip 240 is against the inner surface 225 of the sleeve 221, the edge 244 of the lip 240 is turned forward toward the front end 222 of the sleeve 221, the edge 244 protrudes slightly into the jacket 90 and engages with the jacket 90, and the face 242 of the lip 240 is in contact with the braided jacket 90 as well.

Figure 7C:
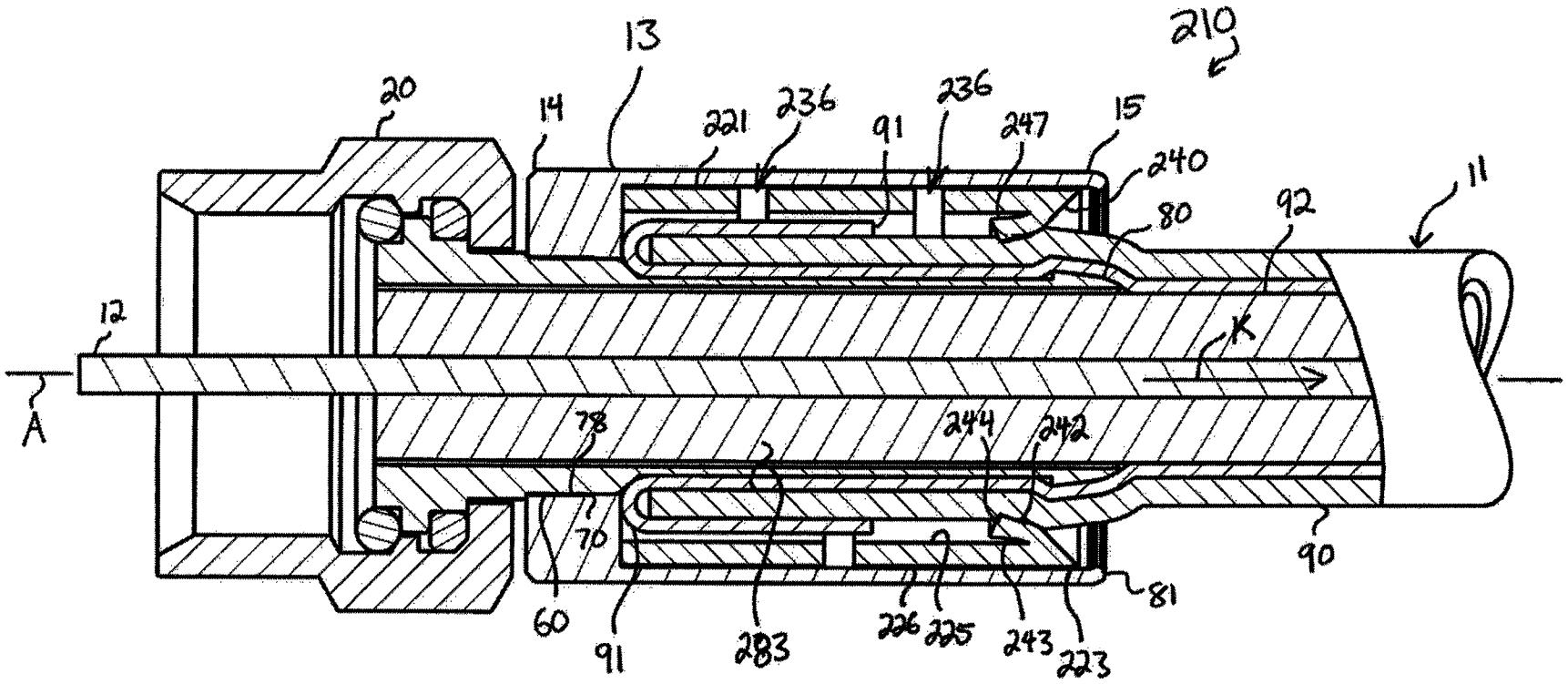

Slight retraction of the cable 11 with respect to the body 13 of the connector 10 along line K moves the cable 11 and sleeve 221 rearwardly, so that the sleeve 221 is in the uncompressed condition seen in FIG. 7C and the rear end 223 of the sleeve 221 is against the mouth 81 of the body 13. The sleeve 221 lengthens, and the slots 231 expand and return to their respective original shapes. The rear end 223 of the sleeve 221 advances back to the rear end 15 of the body 13, and the rear end 223 is there limited from further movement along line K by the inwardly-turned mouth 81, which captures and prevents the rear end 223 of the sleeve 221 from moving out of the rear bore 83.

The slight retraction also causes the lip 240 to turn or buckle inwards slightly, catching and binding with the braids of the jacket 90 in an engagement position. In this arrangement, the lip 240 forms an engagement element binding and permanently coupling the sleeve 221 to the cable 11 and preventing rearward movement or retraction of the cable 21 with respect to the sleeve 221 along line K in FIG. 7C. With the cable 11 coupled to the sleeve 221, and the sleeve 221 prevented from rearward movement beyond the mouth 81 of the body 13, the cable 11 is prevented from removal out of the connector 210 and is prevented from removal off of the inner post 60. The lip 240 is maintained in the deflected condition thereof, engaged with the jacket 90 and crimping the cable 11 against the ridge 80, maintaining the position of the cable 11 with respect to the inner post 60, and maintaining electrical contact and communication between the shield 91 and the inner post 60. Application of the cable 11 to the connector 210 as described herein takes approximately one second, and is accomplished in a single, continuous, fluid forward and twisting motion. The connector 210 is now applied to the cable 11 and ready for operation.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

1. A coaxial cable connector for connecting to a coaxial cable, the connector comprising:

a body having a longitudinal axis and bounding an interior of the body;

a mouth at a rear entrance to the interior of the body;

a sidewall within the interior and extending forwardly from the mouth; and a pawl formed flexibly to and integrally with the sidewall at the mouth, the pawl carried in the interior of the body for flexibly engaging with the coaxial cable applied to the interior and preventing removal of the coaxial cable after being so applied to the interior.

2. The coaxial cable connector of claim 1, wherein the pawl moves out of and into interference with the cable in response to introduction of the cable into the interior and to retraction of the cable along the longitudinal axis, respectively.

3. The coaxial cable connector of claim 1, wherein the pawl is a lip extending continuously around an inner surface bounding the interior of the body.

4. The coaxial cable connector of claim 1, wherein the pawl is directed forwardly along the longitudinal axis and radially inward toward the longitudinal axis.

5. The coaxial cable connector of claim 1, wherein the pawl projects radially inwardly and forwardly over the sidewall.

6. The coaxial cable connector of claim 1, wherein the pawl deflects against the sidewall in response to introduction of the cable into the interior.

7. A coaxial cable connector for connecting to a coaxial cable, the connector comprising:

a body having a longitudinal axis and an interior;

a mouth at a rear entrance to the interior of the body;

a pawl flexibly carried in the interior of the body at the mouth, the pawl configured to flexibly engage with the coaxial cable applied to the interior and to prevent removal of the coaxial cable after being so applied to the interior.

8. The coaxial cable connector of claim 7, wherein the pawl moves out of and into interference with the cable in response to introduction of the cable into the interior and to retraction of the cable, respectively.

9. The coaxial cable connector of claim 7, wherein the pawl is a lip extending continuously around an inner surface bounding the interior.

10. The coaxial cable connector of claim 7, wherein the pawl is directed forwardly along the longitudinal axis and radially inward toward the longitudinal axis.

11. The coaxial cable connector of claim 7, wherein the pawl projects radially inwardly and forwardly over the sidewall.

12. The coaxial cable connector of claim 7, wherein the pawl deflects against the sidewall in response to introduction of the cable into the interior.

13. A coaxial cable connector for connecting to a coaxial cable, the connector comprising:

a body having a longitudinal axis, an interior, and an entrance to the interior;

a sidewall and an inwardly-directed lip formed integrally to the sidewall, the lip disposed at the entrance to the interior and mounted to move flexibly between an interference condition and a deflected condition;

in the interference condition, the lip is biased toward the longitudinal axis and away from the sidewall; and in the deflected condition, the lip is biased away from the longitudinal axis and toward the sidewall.

14. The coaxial cable connector of claim 13, wherein the lip moves to the deflected condition in response to introduction of a cable into the interior, and moves to the interference condition in response to retraction of the cable from the interior.

15. The coaxial cable connector of claim 13, wherein the lip extends continuously around an inner surface bounding the interior of the body.

16. The coaxial cable connector of claim 13, wherein the lip is directed forwardly along the longitudinal axis and radially inward toward the longitudinal axis.

17. The coaxial cable connector of claim 13, wherein the pawl projects radially inwardly and forwardly over the sidewall.

* * * * *